US006561622B1

(12) United States Patent
Suzuki et al.

(10) Patent No.: US 6,561,622 B1
(45) Date of Patent: May 13, 2003

(54) INK-JET RECORDING APPARATUS

(75) Inventors: Kazunaga Suzuki, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/460,413

(22) Filed: Dec. 13, 1999

(30) Foreign Application Priority Data

Dec. 14, 1998 (JP) ..... 10-354627
Dec. 17, 1998 (JP) ..... 10-359066
Oct. 18, 1999 (JP) ..... 11-295385

(51) Int. Cl.[7] ..... B41J 2/165
(52) U.S. Cl. ..... 347/35; 347/23
(58) Field of Search ..... 347/23, 35

(56) References Cited

U.S. PATENT DOCUMENTS 5,049,898 A * 9/1991 Arthur et al. ..... 347/19
5,109,233 A 4/1992 Nishikawa
5,543,826 A 8/1996 Kuronuma et al.
5,617,122 A 4/1997 Numata et al.
5,831,646 A * 11/1998 Kuronuma et al. ..... 347/23
6,299,277 B1 * 10/2001 Fujii ..... 347/23

FOREIGN PATENT DOCUMENTS

EP 0442438 8/1991
EP 0444654 9/1991
JP 57-51474 * 3/1982 ..... B41J/3/04
JP 63-252748 * 10/1988 ..... 347/23
JP 05318718 12/1993
JP 06246931 9/1994
JP 7-47696 2/1995
JP 7-144419 6/1995
JP 10-146993 A * 6/1998 ..... B41J/2/165

* cited by examiner

*Primary Examiner*—Judy Nguyen
(74) *Attorney, Agent, or Firm*—Wenderoth, Lind & Ponack, L.L.P.

(57) ABSTRACT

An ink-jet recording apparatus includes a recording head 6 having a plurality of nozzles which are classified into at least two classes, and a driver 29 for causing ink to be jetted from the nozzles 15 to carry out a flushing operation. A setting unit 38 sets up volumes of ink which should be jetted from the nozzles 15 in such a manner that a volume of ink which should be jetted from a nozzle of a class is set up separately from a volume of ink which should be jetted from a nozzle of another class. A recovering operation controller 30 causes the driver to carry out the flushing operation of the nozzles 15 so that volumes of ink actually jetted from the nozzles 15 during the flushing operation are respectively coincident with the volumes of ink set up by the setting unit 38. The ink-jet recording apparatus can carry out the flushing operation more efficiently.

35 Claims, 15 Drawing Sheets

INK-JET RECORDING APPARATUS

FIELD OF THE INVENTION

This invention relates to an ink-jet recording apparatus having an ink-jet recording head capable of jetting ink from nozzles to form dots on a recording medium according to printing data. In particular, this invention is related to an ink-jet apparatus which can recover nozzles' ability to jet ink by discharging ink with no relation to a printing operation from the nozzles.

BACKGROUND OF THE INVENTION

As shown in FIG. 15, a general ink-jet recording head has: a plurality of nozzles 40 (although only one nozzle is shown in FIG. 15) and a plurality of pressure chambers 41 communicating with the nozzles 40 respectively. A piezoelectric vibrating member 42 is mounted on an outside surface of each elastic wall which partly defines each of the pressure chambers 41. The piezoelectric member 42 expands or contracts depending on a printing signal. Thus, a pressure in each of the pressure chambers 41 is changed to jet ink 44 from the pressure chamber 41 through the nozzle 40 as an inkdrop 45.

In recent apparatuses for printing color images, plural color types of ink may be used as the ink 44, which may include yellow ink, magenta ink, cyan ink as well as black ink. The nozzles 40 are arranged for each of the color inks.

In the above recording head, the ink 44 in the nozzles 40 may dry up to clog the nozzles 40 therewith while the recording head remains stopped after a printing operation. Then, the nozzles are sealed by a capping unit except while the recording head is in the printing operation. However, solvent of the ink 44 in the nozzles 40 may gradually evaporate to increase a viscosity of the ink 44 if the nozzles are sealed for a long time. In the case, it may be difficult to start a printing operation immediately. In addition, there may be some troubles, for example that quality of printed images may deteriorate.

During the printing operation, the nozzles 40 frequently jetting inkdrops 45 are scarcely clogged with the ink 44 because new ink 44 is supplied thereinto in succession. However, even during the printing operation, the nozzles 40 rarely jetting inkdrops 45, for example the nozzles arranged at an upper end portion or a lower end portion, are liable to be clogged with the ink 44 because the ink 44 in such nozzles 40 is liable to dry to increase the viscosity thereof.

To solve the above problems, a "flushing operation" or a "cleaning operation" is carried out by forcibly discharging the clogging ink 44 from the nozzles 40 in no relation to the printing operation, to recover the ability of the nozzles 45 to jet inkdrops. The above flushing or cleaning operation may be carried out when power supply starts to be given to the recording apparatus or when a first printing signal is inputted to the recording apparatus, as a preparatory step before the printing operation.

In the flushing operation, a driving signal in no relation to the printing data is supplied to the piezoelectric vibrating members 42 to jet the clogging ink 44 having a relatively increased viscosity from the nozzles 40. The cleaning operation is carried out when the ability of the nozzles to jet inkdrops is not sufficiently recovered by the flushing operation. In the cleaning operation, a suction pump applies a negative pressure to the nozzles 40 to forcibly suck the clogging ink 44 having a relatively increased viscosity from the nozzles 40.

The degree of the increasing viscosity of the ink 44 in the nozzles 40, i.e., the degree to which the nozzles 40 are clogged becomes worse depending on the length of the capping time for which the recording head remains sealed by the capping unit or the length of the total printing time until the recording head is sealed by the capping unit.

Therefore, as shown in FIG. 16, whether the flushing operation or the cleaning operation should be carried out is determined by the combination of the capping time and the total printing time. The flushing operation is carried out when the capping time or the total printing time is relatively short (see a flushing area in FIG. 16). The cleaning operation is carried out when the capping time or the total printing time is relatively long (see a cleaning area in FIG. 16).

As described above, the apparatuses for printing color images use the plural color types of ink including the black ink, the yellow ink, the cyan ink, the magenta ink or the like. The plural color types of ink have different evaporating rates of the solvent thereof. Thus, the respective degrees of the increasing viscosity of the respective types of ink are different even when the capping time and the total printing time are the same. That is, the nozzles may have a different ability to jet ink respectively, even when the nozzles are used in the same condition.

In addition, in the case of the above conventional apparatus, there is a uniform boundary condition for the cleaning operation or the flushing operation. Thus, the cleaning operation may be carried out for the nozzles jetting ink having a relatively low rate of increasing viscosity, even when the ability of the nozzles to jet ink can be recovered by the flushing operation. This may waste ink.

To the contrary, the rate of increasing viscosity of the ink may be too high to recover the ability of the nozzles to jet ink by the flushing operation. In the case, as shown in FIG. 17, a meniscus of the ink in the flushing operation may become unstable and dented deeply and obliquely to take an air bubble in the nozzle 40.

In addition, the nozzles are used for printing with different frequencies respectively. For example, in the apparatus for printing color images which uses the plural types of ink including the black ink, the yellow ink, the cyan ink, the magenta ink or the like, the nozzles for the respective color ink are used with different frequencies respectively. When a nozzle is used with a low frequency, i.e., when inkdrops are jetted from a nozzle at a low frequency, the ink in the nozzle is liable to dry and the viscosity of the ink is liable to increase. Thus, the degrees of the increasing viscosity of ink are different depending on the frequencies of using the nozzles even when the printing time is the same. That is, the nozzles may have a different ability to jet ink respectively, even when the printing time is the same. In the case of the above apparatus, the uniform condition for the cleaning operation or the flushing operation is defined in no relation to the frequencies of using the nozzles. Thus, the cleaning operation may be carried out for the nozzles whose ability to jet ink can be sufficiently recovered by the flushing operation. This may waste ink.

To the contrary, the rate of increasing viscosity of the ink jetted from the nozzles used with only a low frequency may be too high to recover the ability of the nozzles to jet ink by the flushing operation. In the case, as shown in FIG. 17, a meniscus of the ink in the flushing operation may become unstable and dented deeply and obliquely to take an air bubble in the nozzle 40.

On the other hand, the volume of the ink removed in the cleaning operation is larger than that in the flushing operation because the ink is forcibly sucked by the suction pump in the cleaning operation. Thus, it is preferable that the flushing area is as large as possible. That is, it is preferable that the flushing operation is carried out for the conditions of as highly an increasing viscosity as possible of the ink to recover the ability of the nozzles to jet ink. This can reduce the volume of the ink removed to solve the clogging and increase the volume of the ink saved to use for the printing operation. This can also reduce the volume of the wasted ink.

Of course, regarding the cleaning operation, it is also requested that conditions for the cleaning operation be set to reduce the wasted ink.

SUMMARY OF THE INVENTION

The object of this invention is to solve the above problems, that is, to provide an ink-jet recording apparatus that can carry out an efficient flushing operation or an efficient cleaning operation by changing the conditions for the flushing operation or the cleaning operation depending on the nozzles, for example depending on the nozzles for the respective types of the ink.

In order to achieve the object, an ink-jet recording apparatus includes: a recording head having a plurality of nozzles, the nozzles being classified into at least two classes, and a driver for causing ink to be discharged from the nozzles to carry out a recovery operation. A setting unit is provided for setting up volumes of ink which should be discharged from the nozzles in such a manner that a volume of ink which should be discharged from a nozzle of one class is set up separately from a volume of ink which should be discharged from a nozzle of another class, and a recovering operation controller is provided for causing the driver to carry out the recovery operation of the nozzles so that volumes of ink actually discharged from the nozzles are respectively coincident with the volumes of ink set up by the setting unit.

For example, the driver causes ink to be jetted from the nozzles to carry out a flushing operation as the recovery operation, and the setting unit sets up volumes of ink which should be jetted from the nozzles during the flushing operation in such a manner that a volume of ink which should be jetted from a nozzle belonging to one class is set up separately from a volume of ink which should be jetted from a nozzle belonging to another class. The recovering operation controller is a flushing operation controller which causes the driver to carry out the flushing operation of the nozzles so that volumes of ink actually jetted from the nozzles are respectively coincident with the volumes of ink set up by the setting unit.

Alternatively, the driver sucks ink from the nozzles to carry out a cleaning operation as the recovery operation, and the setting unit sets up volumes of ink which should be sucked from the nozzles during the cleaning operation in such a manner that a volume of ink which should be sucked from a nozzle belonging to One class is set up separately from a volume of ink which should be sucked from a nozzle belonging to another class. The recovering operation controller is a cleaning operation controller which causes the driver to carry out the cleaning operation of the nozzles so that volumes of ink actually sucked from the nozzles during the cleaning operation are respectively coincident with the volumes of ink set up by the setting unit.

The class may consist of a plurality of nozzles from which ink having a rate of increasing viscosity is jetted, or a plurality of nozzles classified on the basis of another feature, or only one nozzle.

The setting unit may set up the volumes of ink which should be jetted from the nozzles in the flushing operation in such a manner that a volume of ink which should be jetted from a nozzle belonging to a chosen class and which has a relatively greater rate of increasing viscosity is larger than a volume of ink which should be jetted from a nozzle belonging to another chosen class and which has a relatively smaller rate of increasing viscosity. In the case, when the ink has a relatively greater viscosity, a large volume of the ink can be jetted from the nozzle in the flushing operation to recover the ability of the nozzle to jet ink. Therefore, there is no problem caused by the difference in the rates of increasing viscosity depending on the types of ink and so on. On the other hand, when the ink has a relatively smaller viscosity, a relatively small volume of the ink can be jetted from the nozzle in the flushing operation to recover the ability of the nozzle to jet ink. Therefore, the volume of the waste ink can be restrained even when there is a difference in the rates of increasing viscosity depending on the types of ink and so on. The flushing operation can also make the starting of the printing operation stable. In addition, the flushing operation can prevent an air bubble from being formed in the nozzle from which the ink having a relatively greater viscosity can be jetted.

As described above, the flushing area, which represents conditions capable of recovering the ability of nozzles to jet ink by only the flushing operation, becomes larger than the conventional one by introducing the efficient flushing operation for the nozzles for the respective types of the ink respectively. Therefore, the volume of the waste ink necessary to recover the ability of the nozzle to jet ink can be reduced, and the volume of ink capable of being used for the printing operation can be increased. The total volume of the waste ink can also be reduced.

The flushing operation controller may control the number of inkdrops jetted by the driver. In the case, the numbers of times the ink is jetted in the flushing operation are predetermined for the respective types of the ink respectively. Such a flushing operation can be controlled very simply and easily.

In addition, the ink-jet recording apparatus may include a capping unit capable of sealing the nozzles of the recording head, and a capping time measuring unit for measuring a capping time for which the nozzles of the head are sealed by the capping unit. In the case, the setting unit may set up the volumes of ink which should be jetted from the nozzles in the flushing operation in such a manner that the volumes of ink are larger according to the capping time. That is, the degrees of the viscosity of the ink in the nozzles are judged by the capping time. This flushing operation can be easily controlled to recover the ability of the nozzles to jet ink very efficiently.

The ink-jet recording apparatus may also include a capping unit capable of sealing the nozzles of the recording head, and a printing time measuring unit for measuring a printing time for which the nozzles of the head are away from the capping unit to carry out a printing operation until the nozzles are moved back to and sealed by the capping unit. In the case, the setting unit may set up the volumes of ink which should be jetted from the nozzles in the flushing operation in such a manner that the volumes of ink are larger according to the printing time. That is, the degrees of the viscosity of the ink in the nozzles are judged by the printing time. This flushing operation can be easily controlled to recover the ability of the nozzles to jet ink very efficiently.

When the capping time or the printing time is compared with a plurality of predetermined times, the volumes of ink which should be jetted can be set stepwise to further reduce the wasted ink. The plurality of predetermined times can be different for the respective types of the ink.

The volumes of ink which should be jetted stepping up when the capping time is longer than a predetermined time may be larger for the nozzles jetting ink that has a greater rate of increasing viscosity. Similarly, the volumes of ink which should be jetted stepping up when the printing time is longer than a predetermined time may be larger for the nozzles jetting ink that have a greater rate of increasing viscosity. In these cases, the ability of the nozzles to jet ink can be recovered more surely by jetting the larger volumes of the ink when the ink has a greater viscosity because of the greater rate of increasing viscosity, the long capping time and/or the long printing time.

The ink-jet recording apparatus may include a jetting, number counting unit for counting respective numbers of times the ink has been jetted (i.e., the number of inkdrops jetted) from the nozzles belonging to the respective classes during a printing operation. In the case, the setting unit may set up the volumes of ink which should be jetted from the nozzles during the flushing operation according to the numbers of inkdrops counted by the jetting number counting unit.

In the case, when the ink has a relatively greater viscosity, a large volume of the ink can be jetted from the nozzle in the flushing operation to recover the ability of the nozzle to jet ink. Therefore, there is no problem caused by the difference in the rates of increasing viscosity depending on the frequencies with which, the nozzles are used. On the other hand, when the ink has a relatively small viscosity, a small volume of the ink can be jetted from the nozzle in the flushing operation to recover the ability of the nozzle to jet ink. Therefore, the volume of the waste ink can be restrained even when there is a difference in the rates of increasing viscosity depending on the frequencies with which the nozzles are used. This flushing operation can also make the printing operation stable. In addition, this flushing operation can prevent an air bubble from being formed in the nozzle from which the ink having a relatively greater viscosity can be jetted.

The setting unit may have: a coefficient determining part for determining coefficients according to the numbers of inkdrops counted by the jetting number counting unit, a provisional volume storage unit for storing a predetermined and provisional volume of ink for the flushing operation, and a calculating body for calculating the volumes of ink which should be jetted from the nozzles. In the case, the appropriate conditions for the flushing operation can be easily obtained. The flushing operation is easily controlled, too.

The ink-jet recording apparatus may include a storage unit capable of storing data whether the power supply is given or not. The storage unit can store the numbers of inkdrops (the jetting numbers) counted by the jetting number counting unit at the end of the printing operation. At the next starting of the printing operation, the setting unit can set up the volumes of ink which should be jetted from the nozzles during the flushing operation according to the numbers of inkdrops stored by the storage unit. In the case, the number of times the ink has been jetted in the previous printing operation can be taken into consideration for the flushing operation at the starting of the following printing operation. This flushing operation can recover the ability of the nozzles to jet ink very efficiently to make the starting of the printing operation stable.

The ink-jet recording apparatus may also include the capping unit capable of sealing the nozzles of the recording head, the capping time measuring unit for measuring the capping time for which the nozzles of the head are sealed by the capping unit, and the printing time measuring unit for measuring the printing time for which the nozzles of the head are away from the capping unit to carry out a printing operation until the nozzles are moved back to and sealed by the capping unit, as well as the jetting number counting unit. In the case, the setting unit may set up the volumes of ink which should be jetted from the nozzles in the flushing operation in such a manner that the volumes of ink are larger when either the capping time or the printing time is longer. That is, the degrees of the viscosity of the ink in the nozzles are judged by the capping time and/or the printing time, because the longer the capping time or the printing time is, the more the viscosity of the ink increases and the worse the ability of the nozzle to jet ink deteriorates. The setting unit may also set up the volumes of ink which should be jetted from the nozzles in the flushing operation according to the number of times the ink has been jetted. This flushing operation can recover the ability of the nozzles to jet ink very efficiently. The flushing area can be enlarged, too.

In the case, the volumes of ink which should be jetted in the flushing operation may be larger for the nozzles jetting ink that has a greater rate of increasing viscosity. This flushing operation can recover the ability of the nozzles to jet ink very efficiently according to both the rate of increasing viscosity of the ink and the number of times the ink has been jetted. The flushing area can be enlarged, too.

In addition, the setting unit may set up the volumes of ink which should be jetted from the nozzles during the flushing operation according to the smallest one of the numbers of times counted by the jetting number counting unit. For example, the volumes of ink that should be jetted may be common.

A computer system can control the setting unit for setting up the volumes of ink which should be jetted from the nozzles in the flushing operation in such a manner that a volume of ink which should be jetted from a nozzle of a chosen class is set up separately from a volume of ink which should be jetted from a nozzle of another chosen class. The flushing operation controller can also be controlled by the computer to cause the driver to carry out the flushing operation of the nozzles so that volumes of ink actually jetted from the nozzles during the flushing operation are respectively coincident with the volumes of ink set up by the setting unit.

This invention includes a storage unit capable of being read by a computer, and storing a program for controlling the setting unit and the flushing operation controller in a computer system.

This invention also includes the program itself for controlling the setting unit and the flushing operation controller in the computer system.

Another ink-jet recording apparatus may include: a recording head having a plurality of nozzles, classified into at least two classes, a second driver for sucking ink from the nozzles to carry out a cleaning operation, and a jetting number counting unit for counting respective numbers of inkdrops that have been jetted from the nozzles belonging to the respective classes during a printing operation. A cleaning setting unit is also included for setting up volumes of ink which should be sucked from the nozzles during the cleaning operation in such a manner that a volume of ink which should be sucked from the nozzle belonging to the chosen class is set up separately from a volume of ink which should be sucked from a nozzle belonging to another chosen class according to the numbers of inkdrops counted by the jetting number counting unit. A cleaning operation controller causes the second driver to carry out the cleaning operation of the nozzles so that volumes of ink actually sucked from the nozzles during the cleaning operation are respectively coincident with the volumes of ink set up by the setting unit.

In the case, when the ink has a relatively greater viscosity, a large volume of the ink can be sucked from the nozzles in the cleaning operation to recover the ability of the nozzles to jet ink. Therefore, there is no problem caused by the difference in the respective rates of increasing viscosity depending on the frequencies with which the nozzles are used. This cleaning operation can achieve less wasted ink, and make the printing operation stable.

A computer system can control the jetting number counting unit, the cleaning setting unit, and the cleaning operation controller.

This invention includes a storage unit capable of being read by a computer, storing a program for controlling the jetting number counting unit, the cleaning setting unit and the cleaning operation controller in a computer system.

This invention also includes the program itself for controlling the jetting number counting unit, the cleaning setting unit and the flushing operation controller in the computer system.

DETAILED DESCRIPTION OF THE INVENTION

Embodiments the invention will now be described in more detail with reference to the drawings.

First Embodiment

Figure 1:
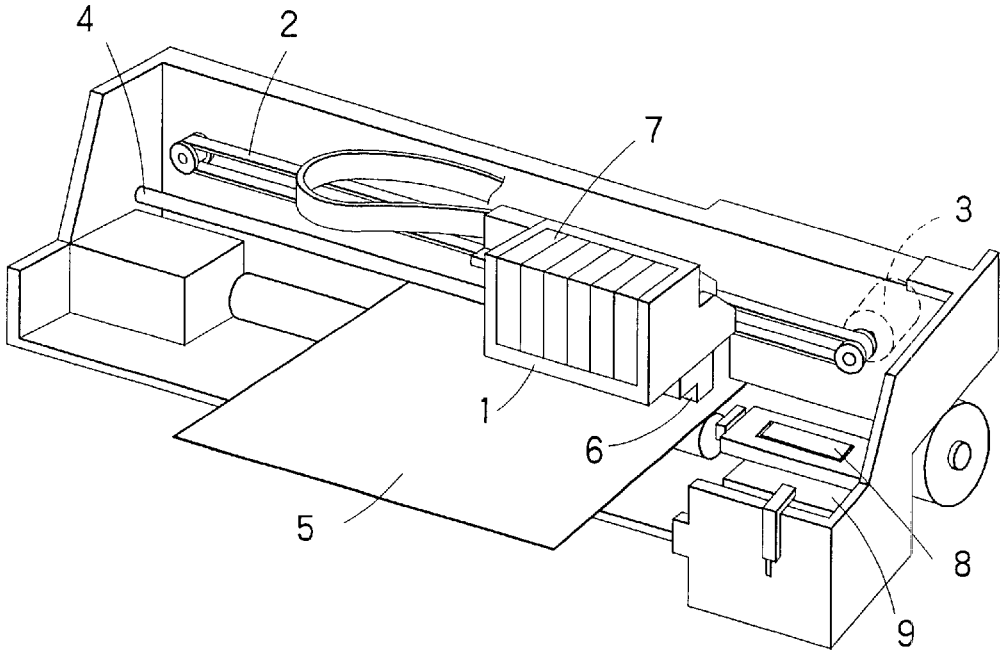
FIG. 1 is a perspective view of a first embodiment of the inkjet recording apparatus according to the invention.

FIG. 1 is a perspective view of first embodiment of the ink-jet recording apparatus according to the invention. The apparatus has a carriage 1 on which a ink cartridge 7 is mounted and under which a recording head 6 is mounted. The apparatus also has a capping unit 8 capable of sealing the recording head 6. The ink cartridge 7 has six ink cartridge chambers which contain cyan ink (C), light cyan ink (LC), magenta ink (M), light magenta ink (LM), yellow ink (Y) and black ink (B), respectively.

The carriage 1 is connected to a pulse motor (a stepping motor) 3 via a timing belt 2 to be reciprocated along a direction of width of a recording paper 5, and which is guided by a guide bar 4. The recording head 6 mounted under the carriage 1 is adapted to face down to the recording paper 5. The inks in the chambers of the ink cartridge 7 are supplied to the recording head 6. While the carriage 1 is moved, the recording head 6 jets ink (ink drops or ink particles) on the recording paper 5 to print images or characters as dot matrices.

The capping unit 8 is disposed in a nonprinting region within a movable region of the carriage 1. The capping unit 8 is adapted to prevent the ink in the nozzles from drying as much as possible by sealing the nozzles of the recording head 6 while the ink-jet recording apparatus is not in the printing operation. The capping unit 8 further functions as a container for receiving ink jetted from the recording head 6 in the flushing operation. In addition, the capping unit 8 is connected to the suction pump 9 to generate a negative pressure therein and to suck ink from the nozzles in the cleaning operation by the negative pressure.

Figure 2:
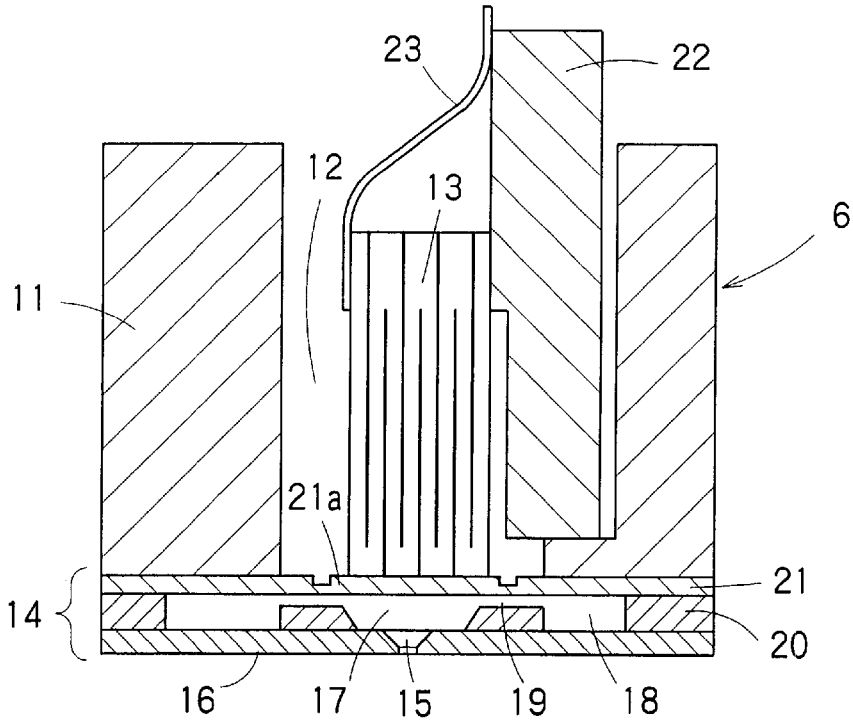
FIG. 2 is a sectional view of an example of the recording head.

FIG. 2 is a sectional view of an example of the recording head 6. The recording head 6 has a base plate 11, piezoelectric vibrating members 13 vibratably contained and mounted in a containing space 12 formed in the base plate 11, and a passage unit 14 fixed to an under surface of the base plate 11.

The passage unit 14 has a nozzle plate 16 having openings as nozzles 15, a thin vibrating plate 21 which can deform elastically, and a passage forming plate 20 sealingly fixed between the nozzle plate 16 and the vibrating plate 21. In the passage forming plate 20, pressure chambers 17 respectively communicating with the nozzles 15, an ink chamber 18 into which the ink is supplied from the respective chambers of the ink cartridge 7, and ink supplying passages 19 respectively connecting the pressure chambers 17 and the ink chamber 18 are formed. The ink chamber 18, the supplying passages 19 and the nozzles 15 are arranged for each of the six color types of ink.

Each of the piezoelectric vibrating members 13 is fixed to a supporting plate 22 fixed in the containing space 12 of the base plate 11 in such a manner that the piezoelectric member 13 can vibrate in the containing space 12. A lower end of the piezoelectric vibrating member 13 adheres to an island portion 21*a* of a vibrating plate 21 of the passage unit 14. A signal cable 23 sends a driving signal to the piezoelectric vibrating member 13.

The recording head 6 operates as described below. At first, electric power is supplied to a piezoelectric vibrating member 13. Then, the piezoelectric vibrating member 13 contracts, a pressure chamber 17 expands, and the pressure therein is reduced. Thus, a meniscus of ink in a nozzle 15 is dented toward the pressure chamber 17, and ink in an ink chamber 18 is supplied into the pressure chamber 17 through an ink passage 19.

When electric charges are discharged from the piezoelectric vibrating member 13 after a predetermined time, the piezoelectric vibrating member 13 returns to an original state thereof Then, the pressure chamber 17 contracts and the pressure therein is increased. Thus, the ink in the pressure chamber 17 is pressed to jet from the nozzle 15 as ink drops, which form images or characters on the recording paper 5.

Figure 3:
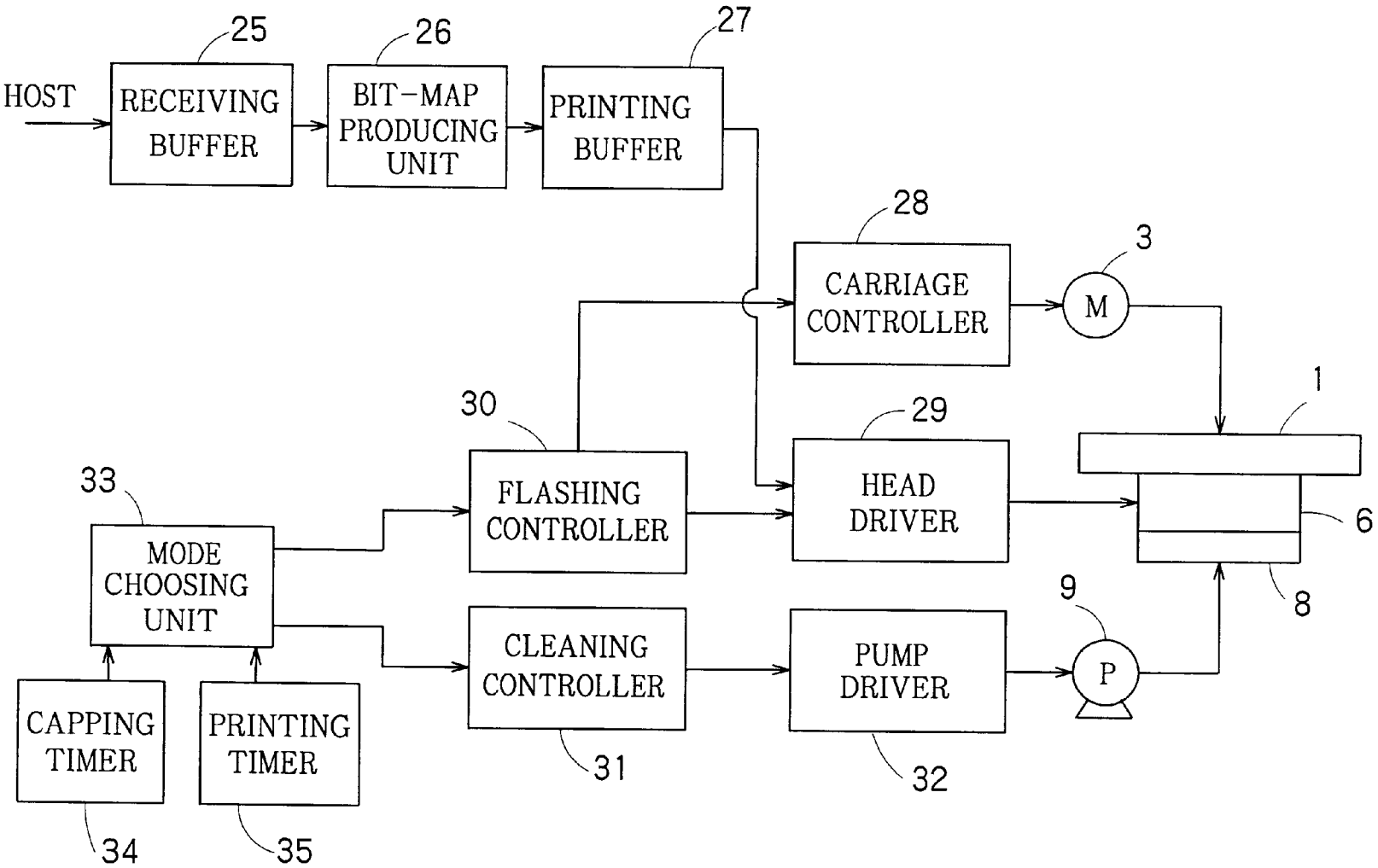
FIG. 3 is a schematic block diagram of the first embodiment of the ink-jet recording apparatus according to the invention.

FIG. 3 is a schematic block diagram of the first embodiment of the ink-jet recording apparatus according to the invention. As shown in FIG.3, a receiving buffer 25 can receive printing data from a host computer (not shown). A bit-map producing unit 26 can convert the printing data into bit-map data. A printing buffer 27 can temporarily store the bit-map data.

A head driver 29 can supply driving voltages to the piezoelectric vibrating members 13 respectively based on a printing signal from the printing buffer 27 to cause the recording head 6 to jet ink to carry out a printing operation. At a starting time of a flushing operation, the head driver 29 can supply driving voltages in no relation to the printing signal to the piezoelectric vibrating members 13 so as to cause the recording head 6 to jet ink to carry out the flushing operation.

A pump driver (second driver) 32 can control the suction pump 9 to generate a negative pressure and to forcibly suck ink from all the nozzles 15 by the negative pressure to carry out a cleaning operation.

A carriage controller 28 can reciprocate the carriage 1 i.e. the recording head 6 via the pulse motor 3 in the printing operation. The carriage controller 28 can move the carriage 1 to such a position that the recording head 6 faces the capping unit 8 before a flushing operation or at the end of the printing operation.

A capping timer 34 (a capping time measuring unit) can start to operate by receiving a signal informing that the recording head 6 is sealed by the capping unit 8 from the carriage controller 28. Thus, the capping timer 34 can measure a capping time during which the nozzles of the recording head 6 remains sealed by the capping unit 8.

A printing timer 35 (a printing time measuring unit) can start to operate by receiving signals informing that the printing operation is started from the head driver 29 and the carriage controller 28. Thus, the printing timer 35 can measure a total printing time from when the recording head 6 is moved away from the capping unit until the recording head 6 is moved back to and sealed by the capping unit 8. The capping timer 34 may be reset when the timer 34 outputs a signal. Similarly, the printing timer 35 may be reset when the timer 35 outputs a signal.

A mode choosing unit 33 (a setting unit, a cleaning setting unit) can receive the signal of the capping time and the signal of the printing time outputted from the capping timer 34 and the printing timer 35, respectively. The mode choosing unit 33 can choose one mode from a flushing mode to carry out a flushing operation and a cleaning mode to carry out a cleaning operation, according to the combination of the capping time and the printing time. Then the mode choosing unit 33 can output a signal of the chosen mode.

A flushing controller 30 can receive the signal from the mode choosing unit 33, and cause the head driver 29 to supply driving voltages to the piezoelectric vibrating members 13 respectively based on the signal to control the flushing operation. The piezoelectric vibrating members 13 can repeatedly expand and contract (vibrate) to jet ink from the nozzles 15 in accordance with the various conditions for the flushing operation.

A cleaning controller 31 can also receive the signal from the mode choosing unit 33, and control the pump driver 32 to control the cleaning operation.

Figure 4:
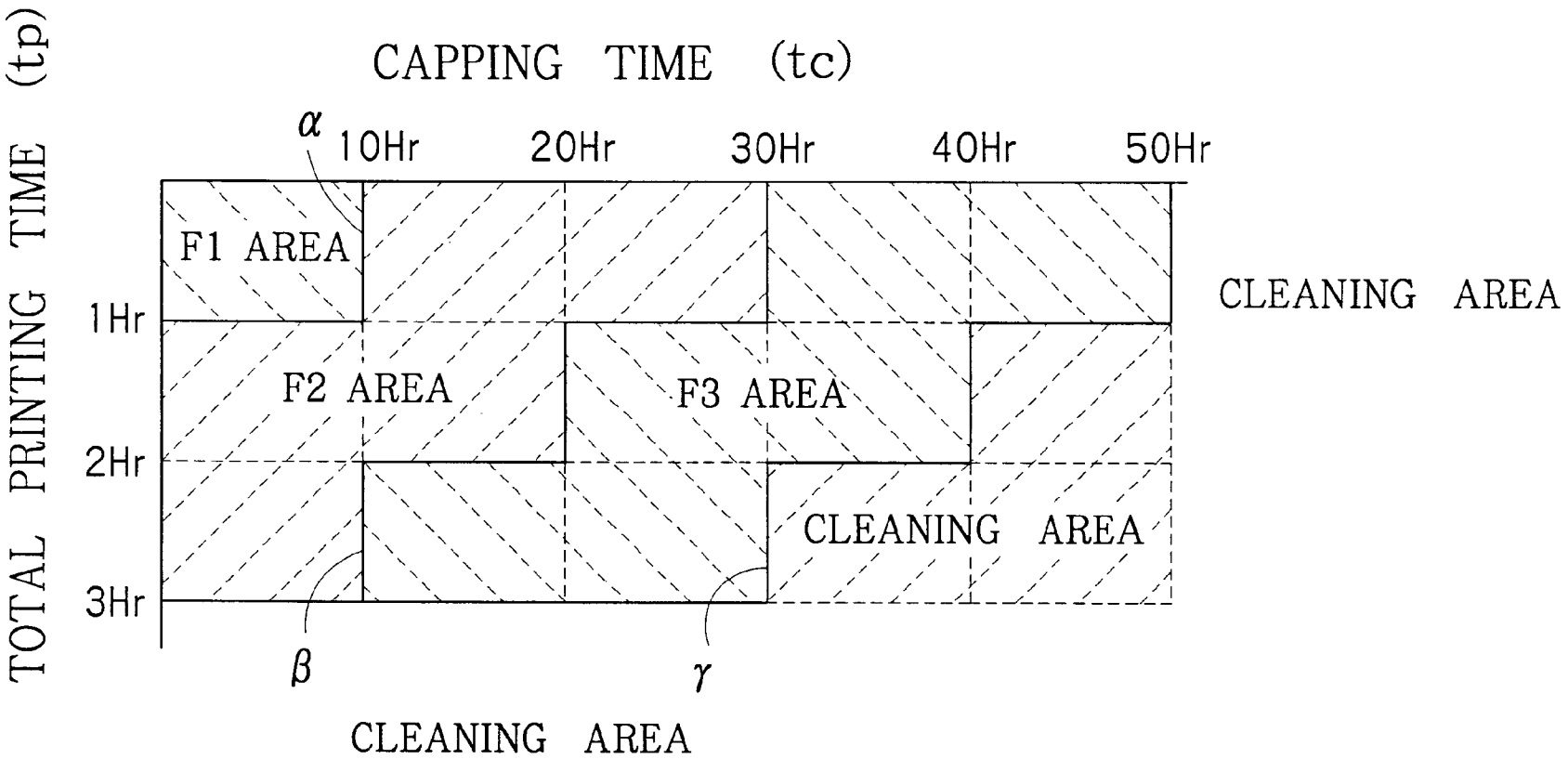
FIG. 4 is a graph representing mode conditions by the capping time and the printing time in the ink-jet recording apparatus shown in FIG. 3.

FIG. 4 is a graph representing mode conditions by the capping time and the printing time in the above jet-ink recording apparatus. In this case, there are four modes including three flushing modes F1 to F3 and one cleaning mode, according to the combination of the capping time and the printing time.

In the case, there are three predetermined times to compare with the total printing time (tp). The predetermined times are 1, 2, and 3 hours. On the other hand, there are five predetermined times to compare with the capping time (tc). The predetermined times are 10, 20, 30, 40 and 50 hours. As shown in FIG. 4, the time area not less than a third standard line γ(the area having a tp less than 1 hour and a tc not less than 50 hours, the area having a tp not less than 1 hour and less than 2 hours and a tc not less than 40 hours, the area having a tp not less than 2 hours and less than 3 hours and a tc not less than 30 hours, and the area having a tp not less than 3 hours) is a cleaning area. The mode choosing unit 33 chooses the cleaning mode for conditions in the cleaning area. The mode choosing unit 33 chooses the flushing modes for conditions in the time area less than the third standard line γ.

The flushing area which is the time area less than the third standard line γ is divided into three stepwise areas. An area F1 is the time area less than a first standard line α (the area having a tp less than 1 hour and a tc less than 10 hours). An area F2 is the time area not less than the first standard line α and less than a second standard line β (the area having a tp less than 1 hour and a tc not less than 10 hours and less than 30 hours, the area having a tp not less than 1 hour and less than 2 hours and a tc less than 20 hours, the area having a tp not less than 2 hours and less than 3 hours and a tc less than 10 hours). An area F3 is the time area not less than the second standard line β and less than the third standard line γ (the area having a tp less than 1 hour and a tc not less than 30 hours and less than 50 hours, the area having a tp not less than 1 hour and less than 2 hours and a tc not less than 20 hours and less than 40 hours, the area having a tp not less than 2 hours and less than 3 hours and a tc not less than 10 hours and less than 30 hours). The mode choosing unit 33 chooses the F1 mode to F3 mode for conditions in the areas F1 to F3 respectively.

The degree of the viscosity of the ink in the nozzles 15 is expected to be greater in the order of the area F1, the area F2 and the area F3. Thus, the ability of the nozzles to jet ink is expected to deteriorate more in the same order. In addition, the rate of increasing viscosity of the respective ink is larger in the order of the black ink (BK), both the cyan ink and the magenta ink (C=M), both the light cyan ink and the light magenta ink (LC=LM), and the yellow ink (Y). Thus, the ability of the nozzles to jet the respective ink is expected to deteriorate faster in the same order. Therefore, preferably, suitable conditions for the flushing operation are prepared respectively for each of the areas F1 to F3, and respectively for the nozzles for each of the color types of ink. That is, the longer time area the condition is in, the more the volume of ink jetted from the nozzles in the flushing operation is set to be. In addition, the greater the rate of increasing viscosity the ink has, the more the volume of the ink jetted from the nozzles in the flushing operation is set to be.

The rate of increasing viscosity of the ink is explained in more detail as below.

In the case of dye ink, the rate of increasing viscosity thereof mainly depends on the volume of solid components therein and on the volume of nonvolatile solvent having a high viscosity therein. The viscosity of the ink is liable to increase by the evaporation of the volatile solvent (for example, water or ethanol) therein if the volume of the solid components and/or the volume of the nonvolatile solvent (for example, glycerin or ethylene glycol) is large.

In the case of pigments ink, the velocity of increasing viscosity thereof also depends on the characteristics of the dispersion elements therein. The viscosity of the ink is liable to increase due to the cohesion of the pigments if the dispersion performance of the dispersion elements is low. The viscosity is not liable to increase in a low frequency (movement), but is liable to increase in a high frequency, because the ink is a non-Newtonian fluid.

For example, actual conditions for the flushing modes F1 to F3 are given as follows.

[Flushing Conditions]

| | | |
|---|---|---|
| F1 mode | :all color types of ink | :5000 shots/nozzle |
| F2 mode | :BK | :15000 shots/nozzle |
| | :C, M | :10000 shots/nozzle |
| | :LC, LM, Y | : 5000 shots/nozzle |
| F3 mode | :BK | :30000 shots/nozzle |
| | :C, M | :20000 shots/nozzle |
| | :LC, LM, Y | :10000 shots/nozzle |

As described above, the conditions for the flushing operation are different for each of the areas divided by the standard lines α, β and γ. In the above example, the longer the capping time or the total printing time is, the more the volume of ink jetted from the nozzles in the flushing operation is set to be. In addition, the larger the rate of increasing viscosity the ink has, the more the volume of the ink jetted from the nozzles in the flushing operation is set to be. In other words, FIG. 4 and the above actual conditions for the various flushing modes illustrate that a flushing condition (in terms of shots per nozzle), which corresponds to an actual rate of increasing viscosity, is based on the capping time, printing time, and type (color) of the ink.

Figure 5:
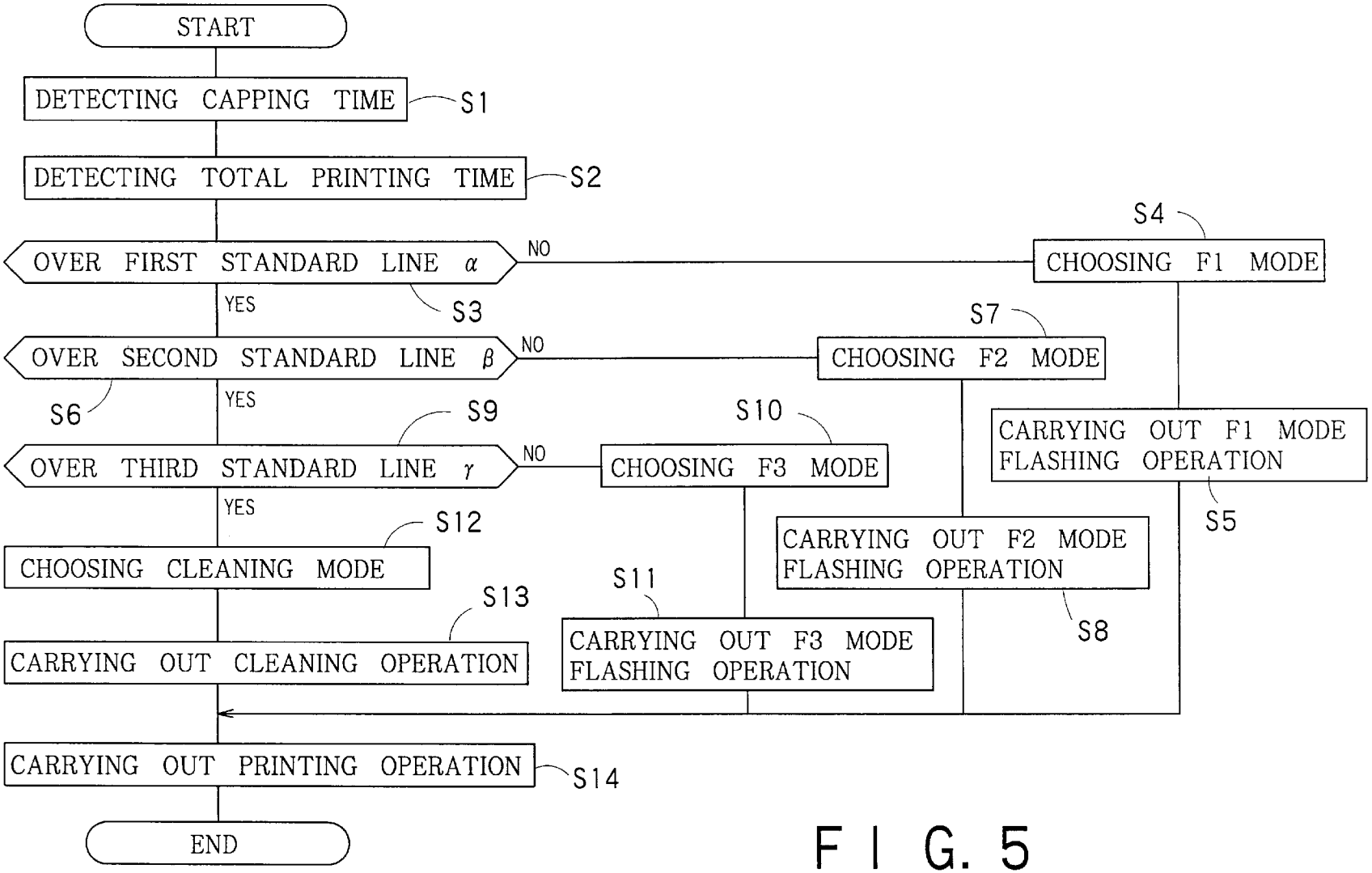
FIG. 5 is a flow chart showing an operation of the ink-jet recording apparatus shown in FIG. 3.

An operation of the ink-jet recording apparatus is explained with reference to the flow chart shown in FIG. 5. S in FIG. 5 means a step.

The capping timer 34 measures and detects the capping time at a starting time of power supply or at a starting time of the printing operation (S1). At substantially the same time, the printing timer 35 measures and detects the printing time (S2). The mode choosing unit 33 determines whether the current condition is over the first standard line α (see FIG. 4) based on the combination of the capping time and the printing time (S3). If the condition is not over the first standard line α, the choosing unit 33 chooses the F1 mode (S4). Then, the flushing operation of the F1 mode is carried out (S5), and then the printing operation is carried out (S14).

If the condition is over the first standard line α, the mode choosing unit 33 judges whether the current condition is over the second standard line β (S6). If the condition is not over the second standard line β, the choosing unit 33 chooses the F2 mode (S7). Then, the flushing operation of the F2 mode is carried out (S8), and then the printing operation is carried out (S14).

If the condition is over the second standard line β, the mode choosing unit 33 judges whether the current condition is over the third standard line γ (S9). If the condition is not over the third standard line γ, the choosing unit 33 chooses the F3 mode (S10). Then, the flushing operation of the F3 mode is carried out (S11), and then the printing operation is carried out (S14).

If the condition is over the third standard line γ, the choosing unit 33 chooses the cleaning mode (S12). Then, the cleaning operation is carried out by the cleaning operation controller 31, the pump driver 32 and the suction pump 9 (S13), and then the printing operation is carried out (S14).

As described above, in this embodiment, when the ink such as BK, C or M has a relatively large rate of increasing viscosity, the volume of the ink jetted from the nozzles in the flushing operation is set to be large. Thus, the ability of the nozzles to jet ink can be recovered sufficiently. On the other hand, when the ink such as Y, LC or LM has a relatively small rate of increasing viscosity, the volume of the ink jetted from the nozzles in the flushing operation is set to be small. Thus, the ability of the nozzles to jet ink can be recovered efficiently. Therefore, the flushing operation can achieve less waste ink necessary to make the starting of the printing operation stable. In addition, the total flushing area can be enlarged by using the flushing conditions different due to the color types of ink. Thus, the wasted ink due to the cleaning operation can be reduced, and the volume of ink to use for the printing operation can be increased. The total volume of the wasted ink can be reduced.

In the above embodiment, the flushing areas F1 to F3 for the flushing modes F1 to F3 are set in the same manner for all the color types of ink, but may be set differently for each of the color types of ink. For example, for the black ink (BK) which has the largest rate of increasing viscosity, the F1 area may be changed into an area having a tp less than 0.5 hour and a tc a less than 5 hours. Then, the F2 area may be changed into an area having a tp less than 0.5 hour and a tc not less than 5 hours and less than 25 hours, an area having a tp not less than 0.5 hour and less than 1.5 hours and a tc less than 15 hours, and an area having a tp not less than 1.5 hours and less than 3.0 hours and a tc less than 5 hours. Then, the F3 area may be changed into an area having a tp less than 0.5 hour and a tc not less than 25 hours and less than 45 hours, an area having a tp not less than 0.5 hour and less than 1.5 hours and a tc not less than 15 hours and less than 35 hours, and an area having a tp not less than 1.5 hours and less than 3.0 hours and a tc not less than 5 hours and less than 25 hours. Then, the cleaning area may be changed into an area except the above changed flushing areas. This flushing operation has a better efficiency for the nozzles jetting the BK.

In the apparatus shown in FIG. 1, the capping unit 8 covers the whole recording head 6 to carry out the cleaning operation. Thus, when the nozzles for one type of ink need a cleaning operation, the cleaning operation is carried out for all the nozzles. Thus, it is preferable that the capping unit 8 is divided into a plurality of portions corresponding to the nozzles for the respective types of ink. In the case, the cleaning operation can be carried out separately for the nozzles for each of the types of ink.

The plural types of ink are not limited to the plural color types of ink. There may be plural types of ink which are the same color. Different types of ink have usually different rates of increasing viscosity.

In the above embodiment, the conditions for the flushing operation are set by the number of times the ink drops are jetted from the nozzles in the flushing operation. However, the conditions may be set by any parameters which can change the volume of the ink jetted from the nozzles in the flushing operation, such as driving voltages of the head driver, parameters of the driving pulses.

Second Embodiment

Figure 6:
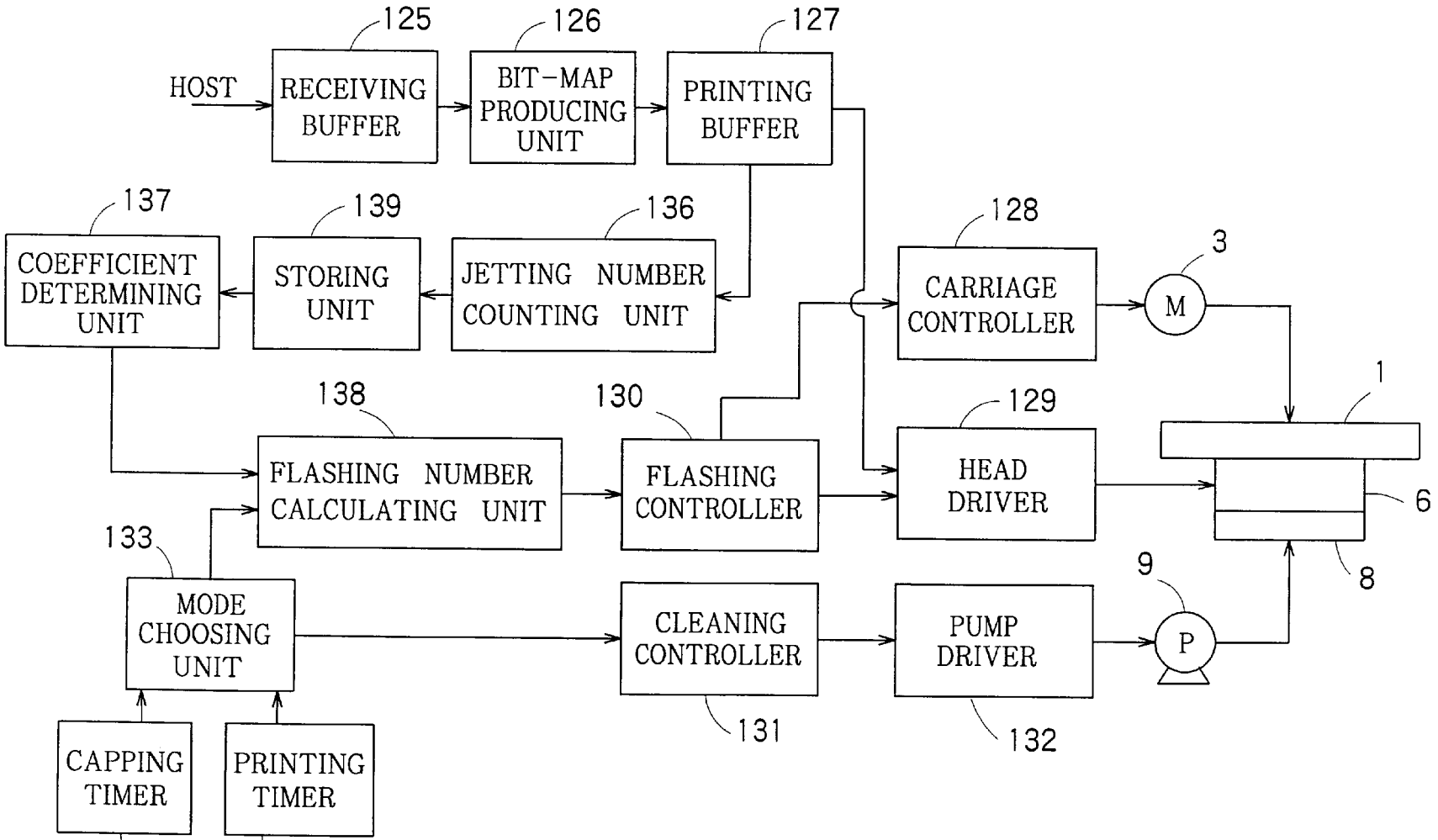
FIG. 6 is a schematic block diagram of a second embodiment of the ink-jet recording apparatus according to the invention.

FIG. 6 is a schematic block diagram of the second embodiment of the ink-jet recording apparatus according to the invention. As shown in FIG. 6, a receiving buffer 125 can receive printing data from a host computer (not shown). A bit-map producing unit 126 can convert the printing data into bit-map data. A printing buffer 127 can temporarily store the bit-map data.

A head driver 129 can supply driving voltages to the piezoelectric vibrating members 13 respectively based on a printing signal from the printing buffer 127 to cause the recording head 6 to jet ink to carry out a printing operation. At a starting time of a flushing operation, the head driver 129 can supply driving voltages in no relation to the printing signal to the piezoelectric vibrating members 13 to cause the recording head 6 to jet ink to carry out the flushing operation.

A pump driver (second driver) 132 can control the suction pump 9 to generate a negative pressure and to forcibly suck ink from all the nozzles 15 by the negative pressure to carry out a cleaning operation.

A carriage controller 128 can reciprocate the carriage 1 i.e. the recording head 6 via the pulse motor 3 in the printing operation. The carriage controller 128 can move the carriage 1 to such a position that the recording head 6 faces the capping unit 8 before a flushing operation or at the end of the printing operation.

A jetting number counting unit 136 can start to operate by receiving a printing signal from the printing buffer 127. The jetting number counting unit 136 can count respective numbers of times ink has been jetted from the nozzles (jetting number) for the respective color types of ink in the printing operation when the recording head 6 is away from the capping unit 8 until the recording head 6 is moved back to and sealed by the capping unit 8. In other words, the jetting number counting unit can count the number of ink drops jetted from each of a first and second class of nozzles. A storing part 139 can temporarily store the numbers of times (jetting numbers) counted by the jetting number counting unit 136 as jetting ratios. The jetting ratio is the percentage of the number of times ink has been jetted (jetting number) to the whole printing area of the recording paper 5.

A setting unit includes several portions for determining the volume of ink to be jetted from the nozzles. A coefficient determining portion 137 of the setting unit can determine (set up) jetting coefficients (multiplying coefficients) for each class of nozzles based on the jetting ratios outputted from the storing part 139 in such a manner that a jetting coefficient is larger when a jetting ratio is smaller. The jetting number counting unit 136 may be reset when the unit outputs the jetting numbers to the storing part 139.

For example, the coefficient determining part 137 determines the jetting coefficients based on the jetting ratios as follows. The conversions of the jetting ratios into the jetting coefficients are carried out for the nozzles 15 for the respective color types of ink.

[Conversion Table]

| Jetting Ratio | | Jetting Coefficient |
|---|---|---|
| 0 to 3% | → | 3.0 |
| 3 to 10% | → | 2.0 |
| 10 to 30% | → | 1.5 |
| 30 to 50% | → | 1.0 |
| 50 to 100% | → | 0.5 |

A capping timer 134 (a capping time measuring unit) can start to operate by receiving a signal informing that the recording head 6 is sealed by the capping unit 8 from the carriage controller 128. Thus, the capping timer 134 can measure a capping time during which the nozzles of the recording head 6 remain sealed by the capping unit 8.

A printing timer 135 (a printing time measuring unit) can start to operate by receiving signals informing that the printing operation is started from the head driver 129 and the carriage controller 128. Thus, the printing timer 135 can measure a total printing time from when the recording head 6 is away from the capping unit 8 until the recording head 6 is moved back to and sealed by the capping unit 8. The capping timer 134 may be reset when the timer 134 outputs a signal. Similarly, the printing timer 135 may be reset when the timer 135 outputs a signal.

Figure 16:
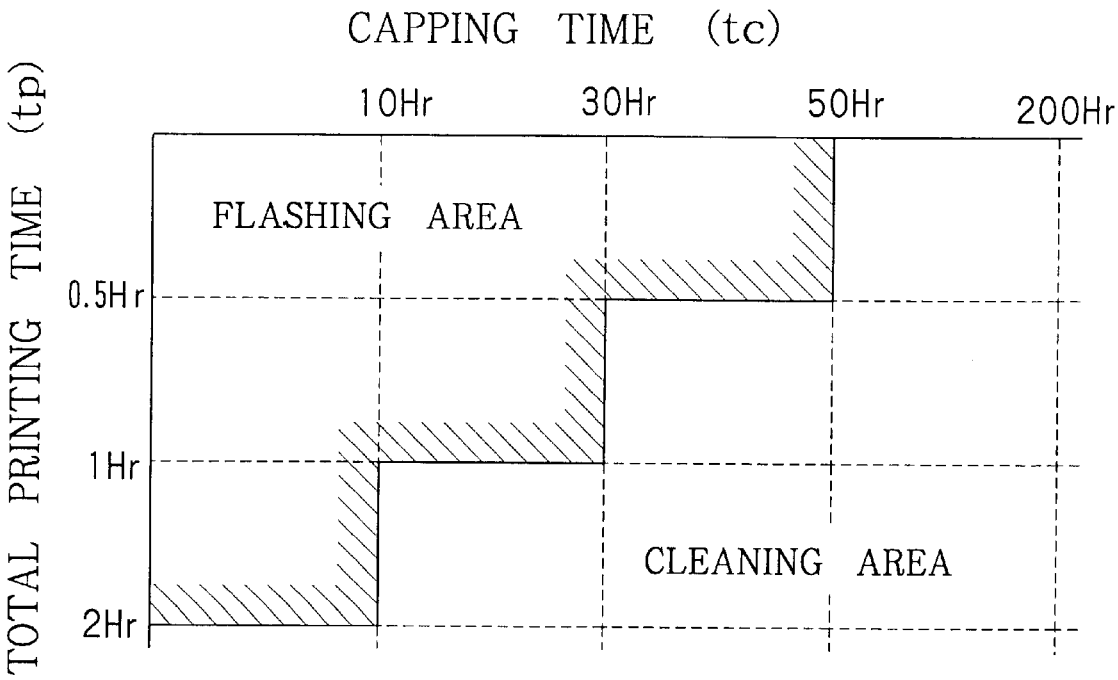
FIG. 16 is a graph representing mode conditions by the capping time and the printing time in the conventional ink-jet recording apparatus.
Figure 17:
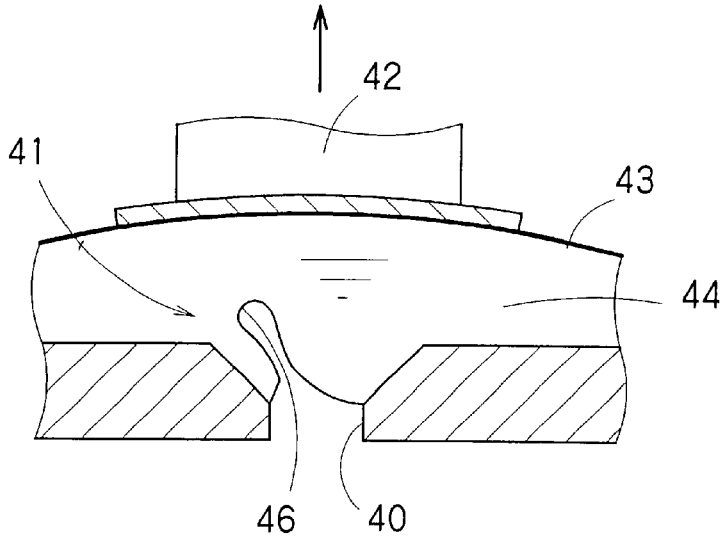
FIG. 17 is a sectional view of the recording head of the conventional ink-jet recording apparatus for explaining a state of the meniscus in the flushing operation.

A mode choosing unit 133 (comprised of a setting unit, including a provisional volume storage unit, a provisional volume determining unit, a cleaning setting unit) can receive the signal of the capping time and the signal of the printing time outputted from the capping timer 134 and the printing timer 135, respectively. The mode choosing unit 133 can choose one mode from a flushing mode to carry out a flushing operation and a cleaning mode to carry out a cleaning operation, according to the combination of the capping time and the printing time. Then the mode choosing unit 133 can output a signal of the chosen mode (see FIG. 16).

The provisional volume determining unit determines provisional flushing numbers for each class of nozzle (as will be described below), and stores the provisional numbers in the provisional volume storage unit. A flushing number calculating unit 138 (a calculating body) can receive a signal of the flushing mode and the provisional flushing number as a provisional volume of ink (for example, 20000 shots/nozzle) from the provisional volume storage unit of the mode choosing unit 133. The flushing number calculating unit 138 can also receive the jetting coefficients for the nozzles 15 for the respective color types of ink from the coefficient determining part 137. The flushing number calculating unit 138 can calculate flushing numbers for each class of nozzle by multiplying the jetting coefficients and the provisional flushing number together respectively. The flushing numbers mean numbers of times the ink should be jetted from the respective nozzles 15 in the flushing operation, and correspond to the volumes of ink which should be jetted in the flushing operation. The provisional volume determining unit determines the flushing numbers based on the actual rate of increasing viscosity of the ink, which is calculated based on both the characteristics of the ink and the jetting number (i.e. measured parameter) during the printing operation.

A flushing controller 130 can receive the flushing numbers calculated by the flushing number calculating unit 138, and cause the head driver 129 to supply driving voltages to the piezoelectric vibrating members 13 respectively based on the flushing numbers to control the flushing operation. The piezoelectric vibrating members 13 can repeatedly expand and contract (vibrate) to jet ink from the nozzles 15 in accordance with the flushing numbers calculated for the nozzles 15 for the respective color types of ink.

A cleaning controller 131 can also receive a signal from the mode choosing unit 133, and control the pump driver 132 to control the cleaning operation.

Figure 7:
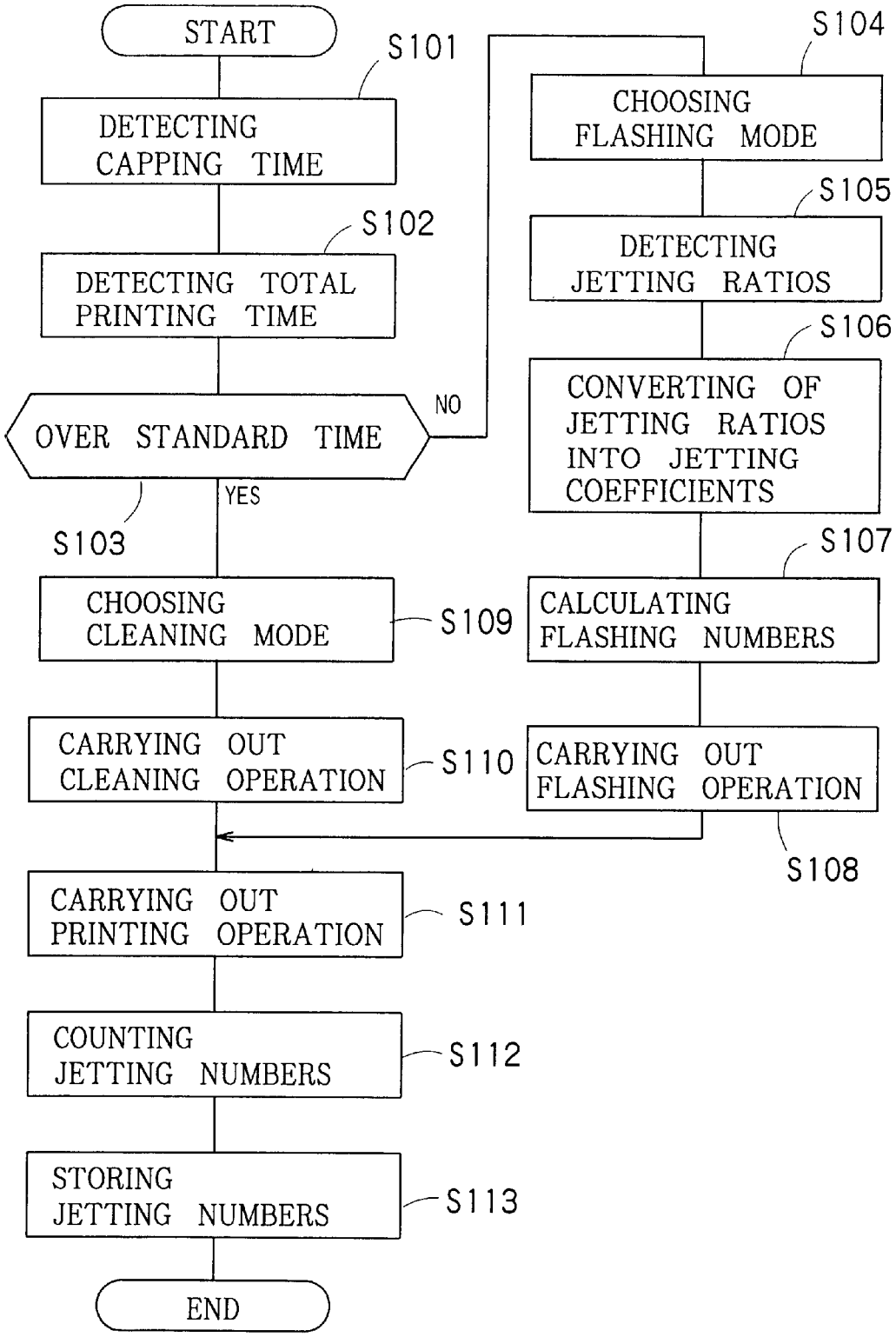
FIG. 7 is a flow chart showing an operation of the ink-jet recording apparatus shown in FIG. 6.

An operation of the ink-jet recording apparatus is explained with reference to the flow chart shown in FIG. 7. S in FIG. 7 means a step.

The capping tuner 134 measures and detects the capping time at a starting time of power supply or at a starting time of the printing operation (S101). At substantially the same time, the printing timer 135 measures and detects the printing time (S102). Like the jetting number (i.e., the number of ink drops jetted from the nozzles), the capping time and printing time are examples of measured parameters of the operation of the ink-jet recording apparatus. The mode choosing unit 133 judges whether the current condition is over a standard line (see FIG. 16) based on the combination of the capping time and the printing time (S103). If the condition is not over the standard line (a flushing area shown in FIG. 16), the choosing unit 133 chooses a flushing mode (S104). If the condition is over the standard line (a cleaning area shown in FIG. 16), the choosing unit 133 chooses a cleaning mode (S109).

If the flushing mode is chosen, the jetting ratios, which are stored in the storing part 139 based on the numbers of jetting times (jetting numbers) counted by the jetting number counting unit 136 at the end of the previous printing operation, are outputted from the storing part 139 and detected by the coefficient determining part 137 (S105). The coefficient determining part 137 converts the jetting ratios into the jetting coefficients (S106). Then, the flushing number calculating unit 138 calculates the flushing numbers for the nozzles 15 for the respective color types of ink by multiplying the jetting coefficients and the predetermined provisional flushing number (determined by the provisional volume determining unit) together respectively (S107). Thus, the appropriate conditions for the flushing operation can be easily obtained by converting the jetting ratios into the jetting coefficients and by calculating the flushing numbers by multiplying the jetting coefficients and the provisional flushing number together.

Then, the flushing controller 130 and the head driver 129 carry out the flushing operation based on the flushing numbers calculated by the flushing number calculating unit 138. That is, ink drops are jetted from the nozzles 15 for the respective color types of ink according to the respective flushing number.

If the cleaning mode is chosen, the cleaning controller 139, the pump driver 132 and the suction pump 9 carry out the cleaning operation (S110). That is, the ink having a large viscosity in all the nozzles 15 of the recording head 6 is forcibly sucked and removed by the negative pressure given by the suction pump 9.

The printing operation is carried out after the flushing operation or the cleaning operation (S111). During the printing operation, the jetting number counting unit 136 counts respective numbers of times ink has been jetted from the nozzles 15 for the respective color types of ink (S112). At the end of the printing operation, the storing part 139 temporarily stores the numbers of jetting times (jetting numbers) counted by the jetting number counting unit 136 as jetting ratios, which mean the percentages of the numbers of times to the whole printing area of one recording paper 5 (S113). The jetting ratios are prepared to calculate the flushing numbers for the flushing operation at the starting of the next printing operation. Thus, the printing at the starting of the printing operation is effectively made stable by considering the jetting numbers for the flushing operation.

In the above embodiment, when ink in the respective nozzles 15 have different viscosities, the ink can be jetted from the nozzles 15 the respective flushing number times in the flushing operation, which number is based on the jetting number having a relation to the difference of the viscosity of the ink. Therefore, there is no problem caused by the difference in the rates of increasing viscosity depending on the frequencies with which the nozzles are used, although the frequencies may be effected by the color types of the ink or the arranged positions of the nozzles 15. That is, the volume of the waste ink can be restrained even when there is a difference in the rates of increasing viscosity depending on the types of ink and so on. The flushing operation can also make the printing operation stable. In addition, the flushing area may become larger by introducing the efficient flushing operation for the nozzles for the types of ink respectively or for all the nozzles. Therefore, the volume of the wasted ink necessary to recover the ability of the nozzles to jet ink can be reduced, and the volume of ink capable of being used for the printing operation can be increased. The total volume of the wasted ink can be also reduced.

In the above example, the jetting coefficients are the same for all the color types of ink. However, the greater the rate of increasing viscosity the ink has, the more the jetting coefficient may be. In the case, the greater the rate of increasing viscosity the ink in the nozzles has, the more the flushing numbers for the nozzles may be. Then, the printing operation may be made more stable, and the flushing area may become larger.

In addition, in the above example, the flushing conditions (flushing numbers) are different by the nozzles even for each color type of ink. However, the same flushing number may be applied to all the nozzles belonging to the same ink-connection for one type of ink. In the case, the flushing number is preferably the one calculated for the nozzle having the smallest jetting coefficient. For example, in one ink-connection, if the smallest jetting coefficient of the nozzles is 3.0, a flushing number that is calculated with the jetting coefficient 3.0 might be applied to all the nozzles. In the case, the head driver may be more easily controlled than in the case of using the respective flushing numbers for the respective nozzles.

Third Embodiment

Figure 8:
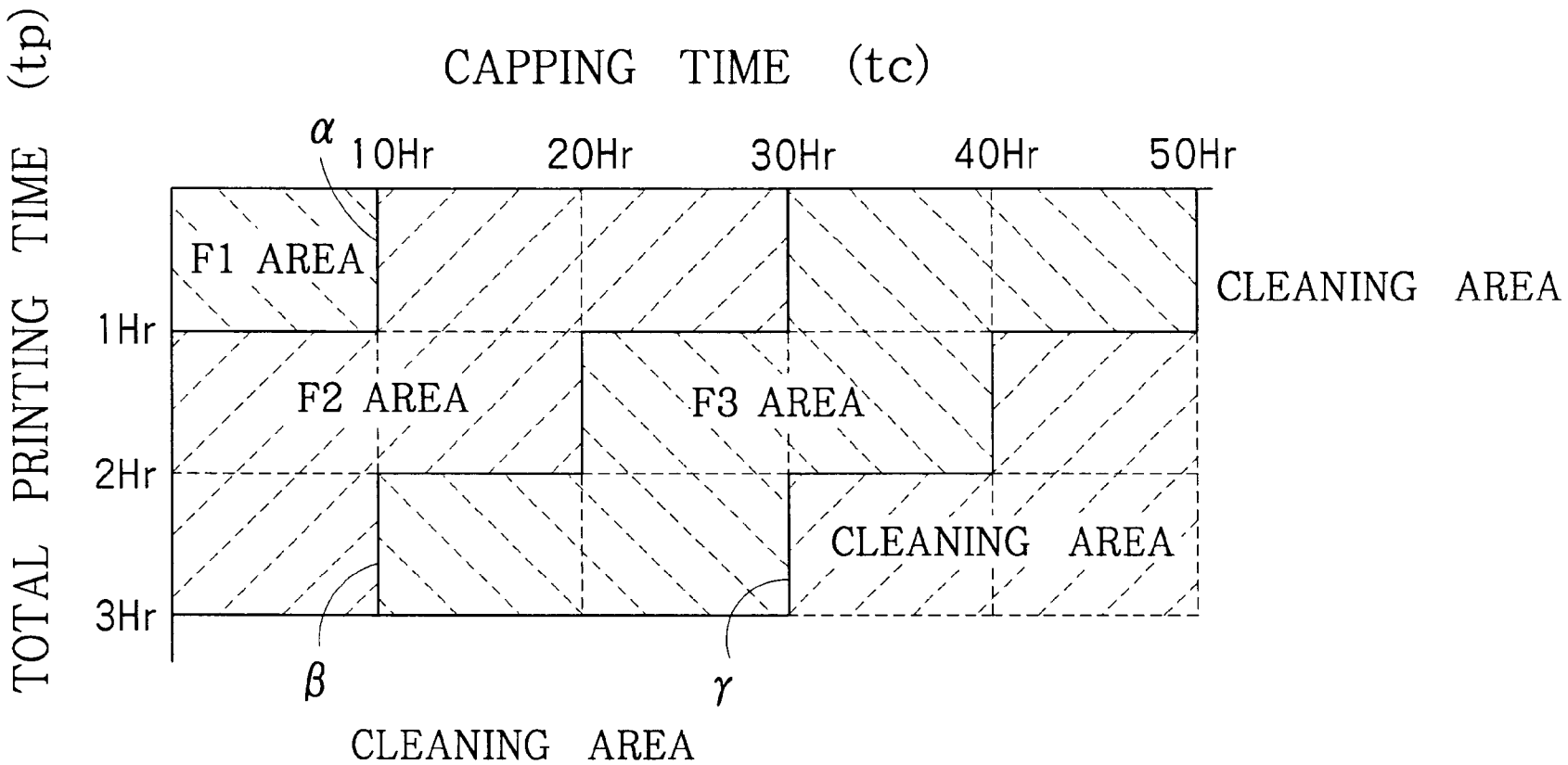
FIG. 8 is a graph representing mode conditions by the capping time and the printing time in a third embodiment of the ink-jet recording apparatus according to the invention.

FIG. 8 is a graph representing mode conditions by the capping time and the printing time in a third embodiment of the ink-jet recording apparatus according to the invention. In the case, for the mode choosing unit 133, there are four modes including three flushing modes F1 to F3 and one cleaning mode, according to the combination of the capping time and the printing time.

The degree of the viscosity of the ink in the nozzles 15 is expected to be greater in the order of the area F1, the area F2 and the area F3. Thus, the ability of the nozzles to jet ink is expected to deteriorate worse in the same order. Therefore, the suitable conditions for the flushing operation are respectively prepared for each of the areas F1 to F3. That is, the longer the time area (with respect to at least one from the capping time and the printing time) that the condition is in, the greater the predetermined provisional flushing number is. For example, the provisional flushing number for the F1 mode is 15000 shots/nozzle, the provisional flushing number for the F2 mode is 20000 shots/nozzle and the provisional flushing number for the F3 mode is 25000 shots/nozzle. The other features are the same as the second embodiment shown in FIG. 6.

An operation of the ink-jet recording apparatus is explained with reference to the flow chart shown in FIG. 9. S in FIG. 9 means a step.

The capping timer 134 measures and detects the capping time at a starting time of power supply or at a starting time of the printing operation (S201). At substantially the same time, the printing timer 135 measures and detects the printing time (S202). The mode choosing unit 133 judges whether the current condition is over the first standard line a (see FIG-8) based on the combination of the capping time and the printing time (S203). If the condition is not over the first standard line a, the choosing unit 133 chooses the F1 mode (S204). Then, the jetting ratios are detected and converted into the jetting coefficients (S205 and S206). The flushing numbers of the F1 mode are calculated from the provisional flushing number of the F1 mode and the jetting coefficients (S207). The flushing operation of the F1 mode is carried out (S208) based on the flushing numbers, and then the printing operation is carried out (S223). At the end of the printing operation, the counted jetting numbers are stored in the storing part 139 as the jetting ratios (S224 and S225).

If the condition is over the first standard line α, the mode choosing unit 133 judges whether the current condition is over the second standard line β (S209). If the condition is not over the second standard line β, the choosing unit 133 chooses the F2 mode (S210). Then, the flushing numbers of the F2 mode are calculated (S211–S213), the flushing operation of the F2 mode is carried out (S214), and then the printing operation is carried out (S223).

If the condition is over the second standard line β , the mode choosing unit 133 judges whether the current condition is over the third standard line γ (S215). If the condition is not over the third standard line γ, the choosing unit 133 chooses the F3 mode (S216). Then, the flushing numbers of the F3 mode are calculated (S217–S219), the flushing operation of the F3 mode is carried out (S220), and then the printing operation is carried out (S223).

If the condition is over the third standard line γ, the choosing unit 133 chooses the cleaning mode (S221). Then, the cleaning operation is carried out (S222), and then the printing operation is carried out (S223). The other steps of the operation are substantially the same as the second embodiment.

In the third embodiment, the longer the time area that the condition is in, the more the predetermined provisional flushing number is, because the ability of the nozzles to jet ink is expected to deteriorate worse as the time (the capping time or the printing time) becomes long. Thus, the flushing operation can be carried out more efficiently by considering the rate of increasing viscosity of the ink. The flushing area may become larger. Otherwise, the third embodiment has substantially the same advantage as the second embodiment.

In the above example, the provisional flushing numbers are predetermined differently for the respective flushing modes. However, the provisional flushing number may be common for all the flushing modes, and the jetting coefficients may be different for the respective flushing modes. For example, the common provisional flushing number may be 15000 shots/nozzle, the jetting coefficients of the F2 mode may be 4/3 times as many as those of the F1 mode, and the jetting coefficients of the F3 mode may be 5/3 times as many as those of the F1 mode. This condition is the same as the above one.

In addition, in the above example, the F3 mode is a flushing mode. However, the F3 mode may be a mode wherein it is determined by the jetting coefficients whether it is a flushing mode or a cleaning mode. In such a mode, for example, when the jetting coefficients are not more than 1.5, the mode is a flushing mode which corresponds to a flushing operation according to the jetting coefficients and the provisional flushing number. When the jetting coefficients are more than 1.5, the mode is a cleaning mode which corresponds to a cleaning operation. In the case, the cleaning operation can be carried out to make the printing operation stable more efficiently by considering the velocity of increasing rate of the ink.

Fourth Embodiment

Figure 10:
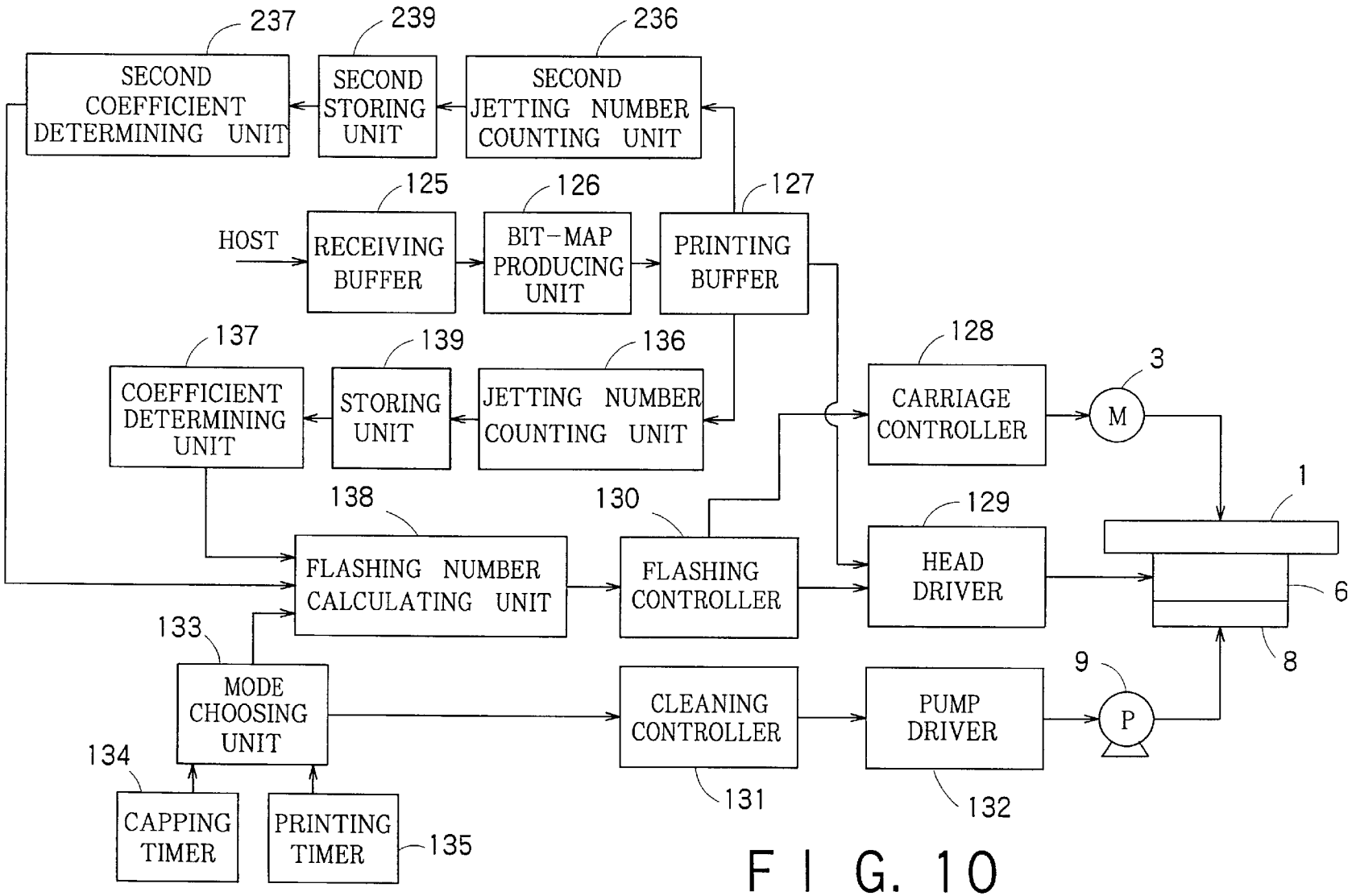
FIG. 10 is a schematic block diagram of a fourth embodiment of the ink-jet recording apparatus according to the invention.

FIG. 10 is a schematic block diagram of a fourth embodiment of the ink-jet recording apparatus according to the invention. The ink-jet recording apparatus further includes a second jetting number counting unit 236, a second storing part 239 and a second coefficient determining part 237. The other features of the fourth embodiment are substantially the same as the second embodiment.

The second jetting number counting unit 236 can count respective numbers of times ink has been jetted from the nozzles for the respective color types of ink, from the latest flushing or cleaning time until the current time in the printing operation, according to information about the latest flushing or cleaning time and a printing signal from the printing buffer 227.

The second storing part 239 can temporarily store the numbers of times (jetting numbers) counted by the second jetting number counting unit 236.

The second coefficient determining part 237 can determine jetting coefficients (multiplying coefficients) based on the jetting ratios outputted from the second storing part 239 in such a manner that a jetting coefficient is larger when a jetting ratio is smaller. The conversions of the jetting numbers into the jetting coefficients are carried out for the nozzles 15 for the respective color types of ink. The conversions of the jetting numbers into the jetting coefficients by the second coefficient determining part 237 may be carried out via jetting ratios the same as the coefficient determining part 137.

The flushing number calculating unit 138 (a calculating body) can receive the jetting coefficients for the nozzles 15 for the respective color types of ink from the second coefficient determining part 237. The flushing number calculating unit 138 can calculate flushing numbers by multiplying the jetting coefficients and a predetermined provisional flushing number (for example, 20000 shots/nozzle) together respectively. The flushing numbers mean numbers of times the ink should be jetted from the respective nozzles 15 in the flushing operation.

The flushing controller 130 can receive the flushing numbers calculated by the flushing number calculating unit 138, and cause the head driver 129 to supply driving voltages to the piezoelectric vibrating members 13 respectively based on the flushing numbers to control the flushing operation. The piezoelectric vibrating members 13 can repeatedly expand and contract (vibrate) to jet ink from the nozzles 15 in accordance with the flushing numbers calculated for the nozzles 15 for the respective color types of ink.

An operation of the ink-jet recording apparatus is explained with reference to the flow chart shown in FIG. 11. S in FIG. 11 means a step.

Figure 11:
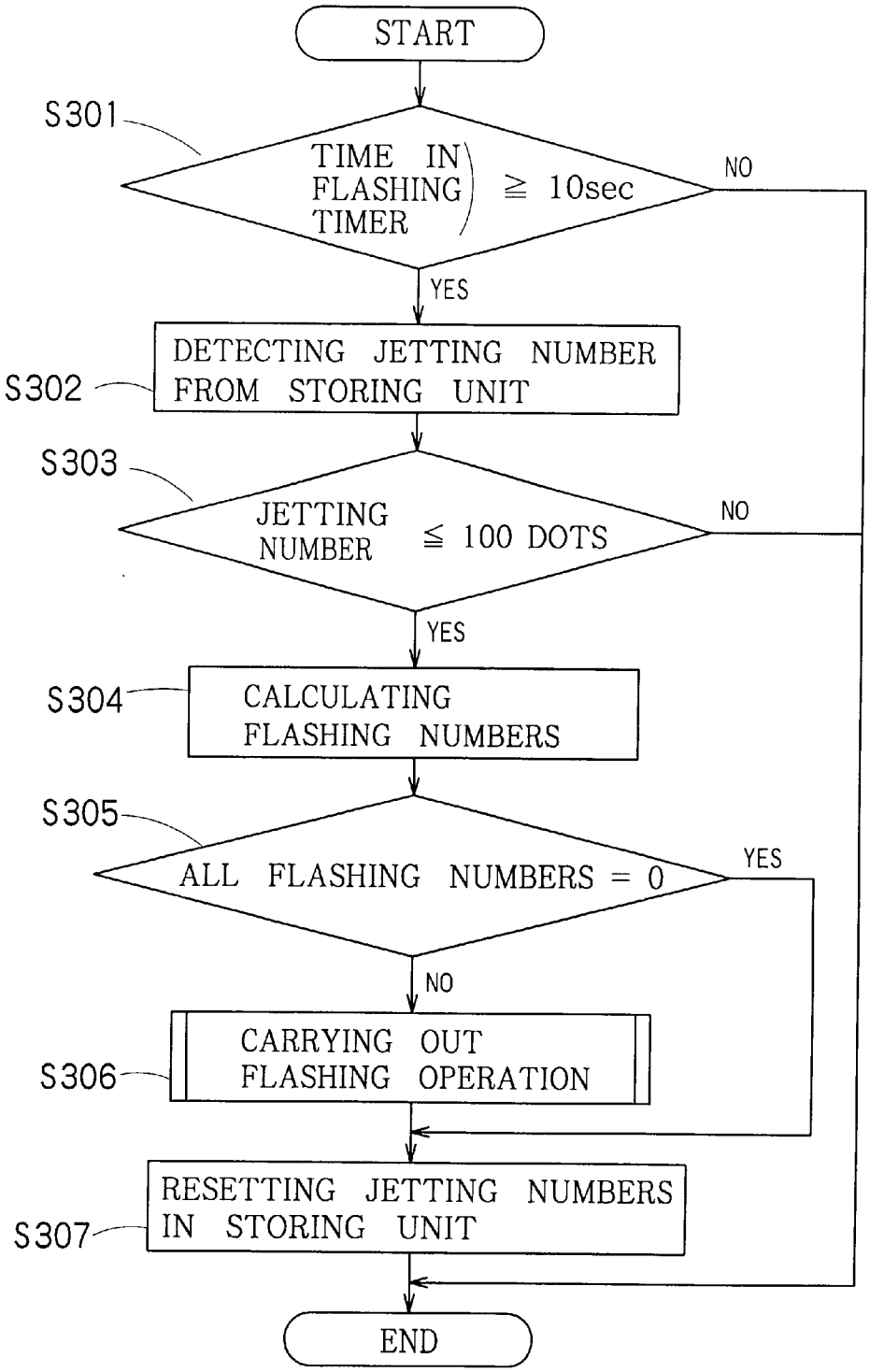
FIG. 11 is a flow chart showing an operation of the ink-jet recording apparatus shown in FIG. 10.

The flow operation shown in FIG. 11 is carried out during the printing operation. For example, the flow operation starts when 2 seconds or more passes after a printing step (for example a one-path printing process) has been completed or when a printing step starts.

The second jetting number counting unit 236 can count respective numbers of times ink has been jetted from the nozzles 15 for the respective color types of ink, from the latest flushing or cleaning time until the current time. The second storing part 239 can store and update the numbers of times (jetting numbers) counted by the second jetting number counting unit 236 every moment.

The second coefficient determining part 237 determines whether 10 seconds or more passes after the latest flushing or cleaning time, using a flushing timer (not shown) which measures the time passing after the latest flushing or cleaning time (S301).

If the time passing after the latest flushing or cleaning time is less than 10 seconds, the flow operation ends without the following steps, to raise the throughput.

If the time passing after the latest flushing or cleaning time is not less than 10 seconds, the jetting numbers (or jetting ratios) stored in the second storing part 239 are outputted and referred to (S302). The second coefficient determining part 237 determines whether the jetting numbers are less than 100 dots or not (S303).

If the jetting numbers are less than 100 dots, the flow operation ends without the following steps, to raise the throughput.

If the jetting numbers are not less than 100 dots, the second coefficient determining unit 237 calculates the jetting coefficients for the nozzles 15 for the respective color types of ink based on the jetting numbers (or jetting ratios). The flushing number calculating unit 138 calculates the flushing numbers for the respective nozzles 15 by multiplying the jetting coefficients from the second coefficient determining unit 237 and the provisional flushing number from the mode choosing unit 133 respectively (S304).

If all the flushing numbers calculated for the nozzles 15 are zero, the following step S306 is skipped to raise the throughput (S305).

If a flushing number is not zero, the flushing controller 130 causes the head driver 129 to supply driving voltages to the piezoelectric vibrating members 13 respectively based on the flushing numbers calculated by the flushing number calculating unit 138. Then, the piezoelectric vibrating members 13 repeatedly expand and contract (vibrates) so that ink drops may be jetted from the respective nozzles 15 for the respective color types of ink the respective flushing number times (S307).

If the flushing operation is carried out, the jetting numbers of the second storing part 239 are reset (S308).

In addition, the flushing timer always operates during the printing operation, i.e., while the nozzles are away from and not sealed by the capping unit. The flushing timer is reset and restarts when a flushing operation or a cleaning operation is carried out.

In the fourth embodiment, when ink in the respective nozzles 15 have different viscosities, the ink can be jetted from the nozzles 15 the respective flushing number of times in the flushing operation, which number is based on the jetting number having a relation to the difference in the viscosity of the ink, during the intermittent printing operations (including the temporarily stop for changing the page or the like). Therefore, there is no problem caused by the difference in the rates of increasing viscosity depending on the frequencies with which the nozzles are used, although the frequencies may be effected by the color types of the ink or the arranged positions of the nozzles 15. That is, the volume of the wasted ink can be restrained even when there is the difference in the rates of increasing viscosity depending on the types of ink and so on. The flushing operation can also make the printing operation stable. In addition, the throughput may be raised by introducing the efficient flushing operation for the nozzles for the types of the ink respectively or for all the nozzles. The volume of the wasted ink necessary to recover the ability of the nozzle to jet ink can be also reduced, and the volume of ink capable of being used for the printing operation can be increased. The total volume of the wasted ink can also be reduced.

The provisional flushing numbers in the second, third and fourth embodiments may be different for the respective color types of ink. For example, the rates of increasing viscosity of the respective ink is larger in the order of the black ink (BK), both the cyan ink and the magenta ink (C=M), both the light cyan ink and the light magenta ink (LC=LM), and the yellow ink (Y). Thus, the ability of the nozzles to jet the respective ink is expected to deteriorate faster in the same order. Therefore, preferably the larger the rate of increasing viscosity the ink has, the greater the provisional flushing number of the nozzle jetting the ink in the flushing operation may be set to. In this case, the flushing number depends on the actual rate of increasing viscosity of the ink, which is calculated based on both the characteristic of the ink itself and the jetting number (i.e., a measured parameter) during the printing operation. That is, the flushing number may be calculated from both the rate of increasing viscosity of the ink and the jetting number (used to calculate the rate of increasing viscosity of the ink) during the printing operation, to carry out the flushing more efficiently.

In the above embodiments, the recording head 6 includes the piezoelectric vibrating members 13 which expand and contract in a longitudinal direction. However, the recording head 6 may include another type of vibrating members which causes pressure chambers to expand or contract by distortion thereof. The recording head 6 may be a bubble-jet recording head.

In addition, when the flushing operation and the cleaning operation are carried out, the carriage is positioned at a predetermined flushing position or a predetermined cleaning position.

In the above embodiments, at least one of the receiving buffer 25, 125, the bit-map producing unit 26, 126, the printing buffer 27, 127, the carriage controller 28, 128, the head driver 29, 129, the flushing controller 30, 130, the cleaning controller 31, 131, the pump driver 32, 132, the mode choosing unit 33, 133, the capping timer 34, 134, the printing timer 35, 135, the jetting number counting unit 36, 136, the coefficient determining part 37, 137, the flushing number calculating unit 38, 138, the storing unit 39, 139, the second jetting number counting unit 236, the second coefficient determining part 237 and the second storing unit 239 may be controlled by one or more computer systems.

A program for controlling the above element or elements in the computer system, and a storage unit storing the program and capable of being read by a computer, are intended to be protected by this application. The above element or elements may be controlled by the computer system by using a general program such as an OS, a program including a command or commands for controlling the general program, and a storage unit storing the program and capable of being read by a computer.

Fifth Embodiment

In addition, the cleaning controller 131 may be adapted to control the pump driver 132 according to the jetting numbers counted by the jetting number counting unit 136. In the case, the cleaning controller 131 may preferably take into consideration the printing time measured by the printing timer 135 and the capping time measured by the capping timer 134. Such an embodiment is explained with reference to FIGS. 12 to 14.

Figure 12:
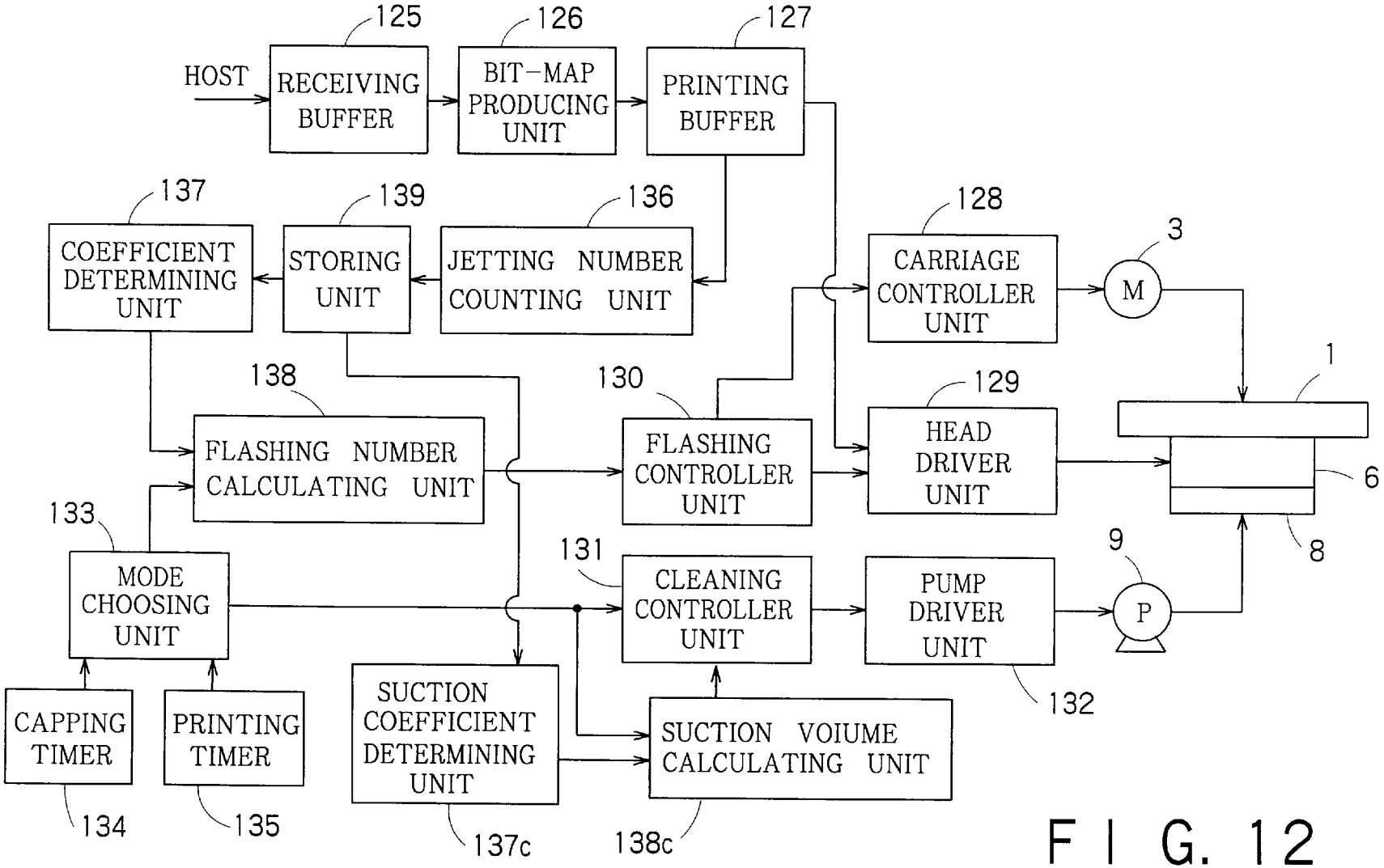
FIG. 12 is a schematic block diagram of a fifth embodiment of the ink-jet recording apparatus according to the invention.

FIG. 12 is a schematic block diagram of a fifth embodiment of the ink-jet recording apparatus according to the invention. As shown in FIG. 12, the suction coefficient determining part 137*c* can determine suction coefficients (multiplying coefficients) based on the jetting ratios outputted from the storing part 139 in such a manner that a suction coefficient is larger when a jetting ratio is smaller. The suction coefficient determining part 137*c* is connected to the cleaning controller 131 through a suction volume calculating unit (calculating body) 138*c*.

The other features of the fifth embodiment are substantially the same as the second embodiment. The reference numerals used in FIG. 12 are the same as in FIG. 6. The explanations of the same elements as the second embodiment are omitted.

For example, the suction coefficient determining part 137*c* determines the suction coefficient based on the jetting ratios as follows. The conversions of the jetting ratios into the suction coefficients are carried out for the nozzles 15 for the respective color types of ink.

[Conversion Table]

| Jetting Ratio | | Suction Coefficient |
|---|---|---|
| 0 to 3% | → | 4.0 |
| 3 to 10% | → | 2.5 |
| 10 to 30% | → | 1.5 |
| 30 to 50% | → | 1.2 |
| 50 to 100% | → | 1.0 |

The suction volume calculating unit (calculating body) 138*c* can receive a signal of the cleaning mode and a provisional suction volume as a provisional volume of ink from the mode choosing unit 133. The suction volume calculating unit 138*c* can also receive the suction coefficients for the nozzles 15 for the respective color types of ink from the suction coefficient determining part 137*c*. The suction volume calculating unit 138*c* can calculate suction volumes by multiplying the suction coefficients and the provisional suction volume together respectively. The suction volumes mean the volumes of the ink that should be sucked from the respective nozzles 15 in the cleaning operation.

Figure 14:
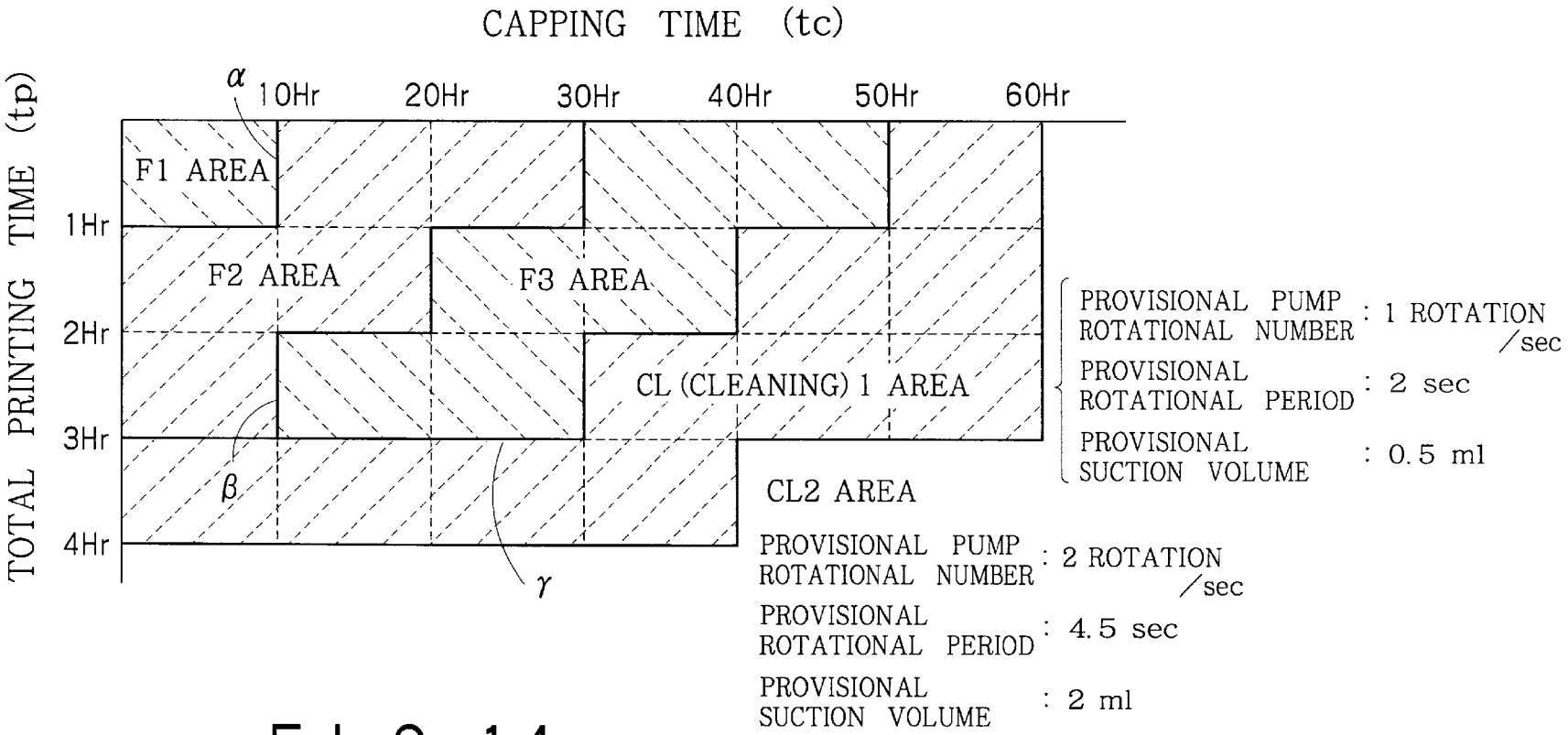
FIG. 14 is a graph representing mode conditions by the capping time and the printing time in the ink-jet recording apparatus shown in FIG. 12.
Figure 15A:
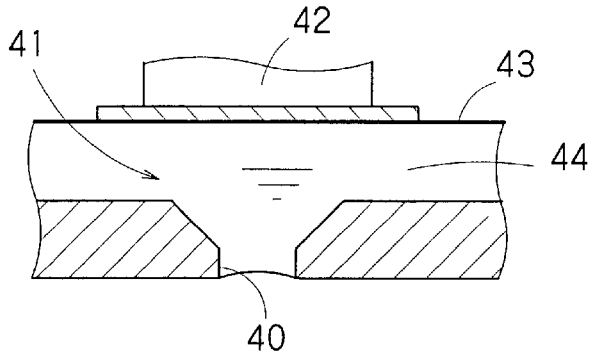
FIGS. 15*a* to 15*c* are sectional views of the recording head of the conventional ink-jet recording apparatus at a normal state, at a state in which the piezoelectric vibrating member contracts, at a state in which an inkdrop is jetted, respectively.
Figure 15B:
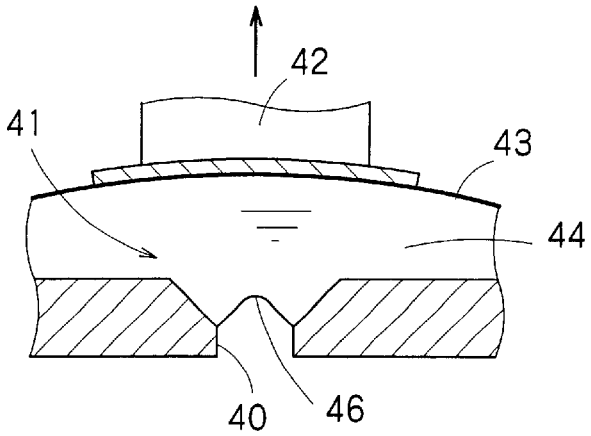
Figure 15C:
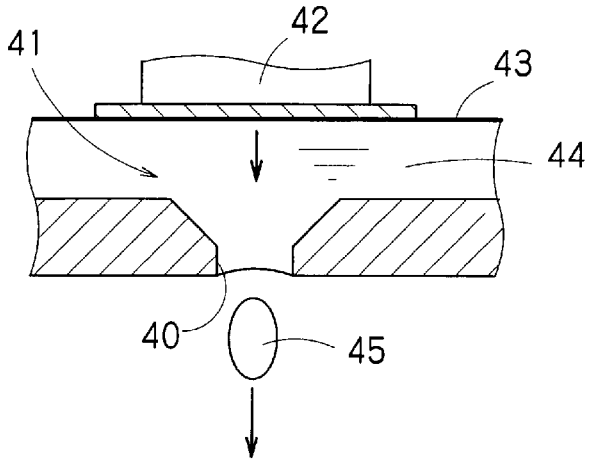

In the case, as shown in FIG. 14, for the mode choosing unit 133, there are two cleaning modes consisting of a CL1 mode and a CL2 mode, according to the combination of the capping time and the printing time.

The degree of the viscosity of the ink in the nozzles 15 is expected to be greater in the order of the area CL1 and the area CL2. Thus, the ability of the nozzles to jet ink is expected to deteriorate worse in the same order. Therefore, suitable conditions for the cleaning operation are prepared respectively for each of the areas CL1 and CL2. That is, the longer the time area (with respect to at least one from the capping time or the printing time) that the condition is in, the more the predetermined provisional suction volume is. For example, the provisional suction volume for the CL1 mode is 0.5 ml, the provisional suction volume for the CL2 mode is 2.0 ml.

The suction volume is controlled by the pump rotational number (velocity) and the pump rotational period of the pump driver 132. In the case, the suction volume 0.5 ml is achieved by the rotational number 1/s and the rotational period 2 s. In the same manner, the suction volume 2.0 ml is achieved by the rotational number 2/s arid the rotational period 4.5 s. In general, the rotational number is controlled easier than the rotational period. Thus, preferably, the rotational number is controlled to achieve the calculated suction volume.

The cleaning controller 131 can receive the suction volumes calculated by the suction volume calculating unit 138*c*, and control the pump driver 132 to carry out the cleaning operation for the nozzles 15 for the respective color types of ink.

Figure 13:
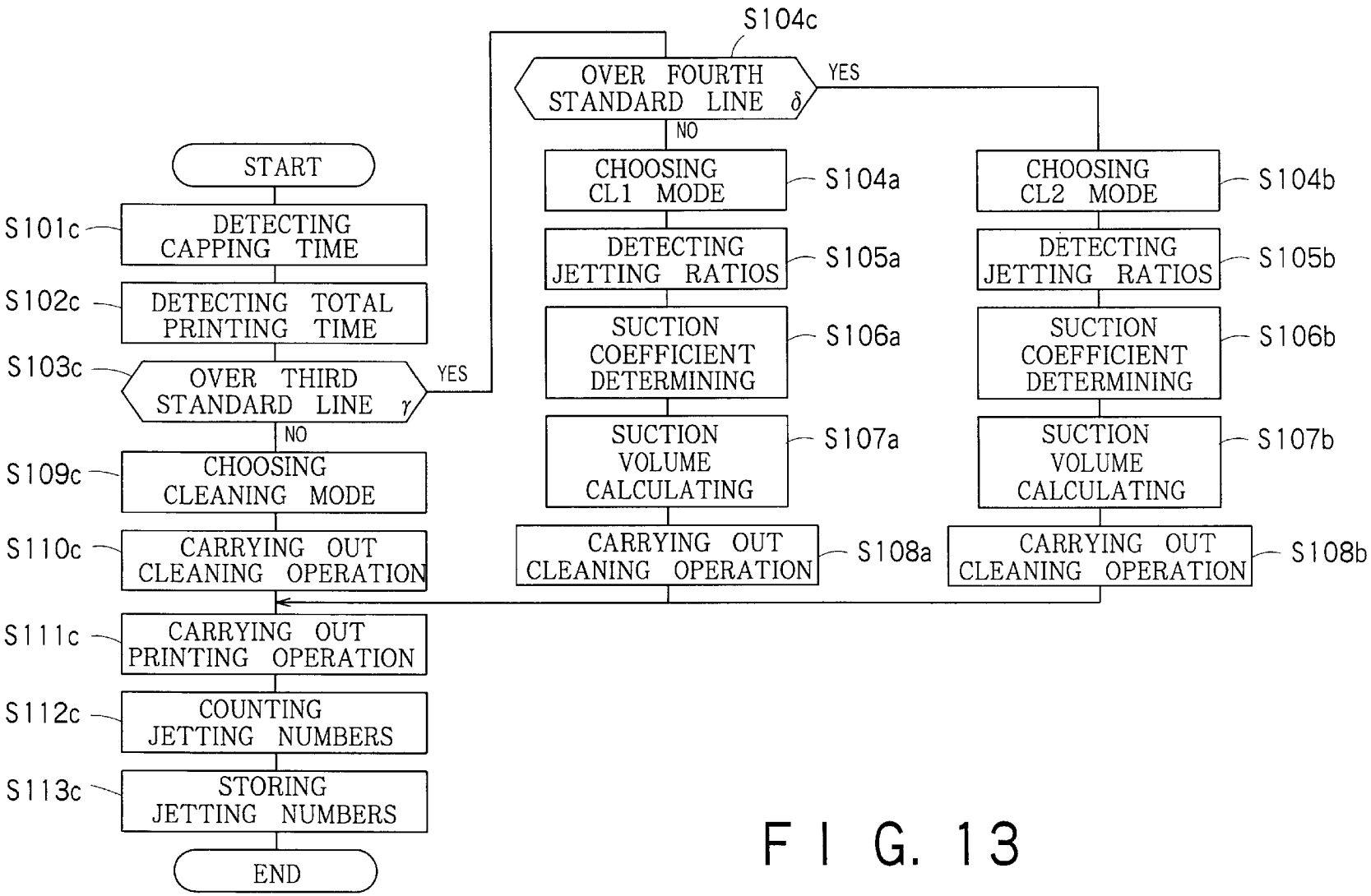
FIG. 13 is a flow chart showing an operation of the ink-jet recording apparatus shown in FIG. 12.

An operation of the ink-jet recording apparatus is explained with reference to the flow chart shown in FIG. 13. S in FIG. 13 means a step.

The capping timer 134 measures and detects the capping time at a starting time of power supply or at a starting time of the printing operation (S101*c*). At substantially the same time, the printing timer 135 measures and detects the printing time(S102*c*). The mode choosing unit 133 judges whether the current condition is over the third standard line y based on the combination of the capping time and the printing time (S103*c*). If the condition is not over the third standard line γ, the choosing unit 133 chooses the respective corresponding flushing modes (S109*c*). The flow operation of this case is the same as the third embodiment shown in FIG. 9.

If the condition is over the third standard line y, the choosing unit 133 judges whether the current condition is over the fourth standard line (5 (S104*c*). Then, the choosing unit 133 chooses the CM cleaning mode or the CL2 cleaning mode (S104*a*, S104*b*).

If the CM or CL2 cleaning mode is chosen, the jetting ratios, which have been stored in the storing part 139 based on the number of times (jetting numbers) counted by the jetting number counting unit 136 by the end of the previous printing operation, are outputted from the storing part 139 and detected by the coefficient determining part 137 (S105*a*, S105*b*). The suction coefficient determining part 137*c* converts the jetting ratios into the suction coefficients (S106*a*, S106*b*). Then, the suction volume calculating unit 138*c* calculates the suction volumes for the nozzles 15 for the respective color types of ink by multiplying the suction coefficients and the predetermined provisional suction volumes together respectively (S107*a*, S107*b*). Thus, the appropriate conditions for the cleaning operation can be easily obtained by converting the jetting ratios into the suction coefficients and by calculating the suction volumes by multiplying the suction coefficients and the provisional suction volumes together.

Then, the cleaning controller 131 and the pump driver 132 carry out the cleaning operation based on the suction volumes calculated by the suction volume calculating unit 138*c* (S108*c*). That is, the respective suction volumes of the ink are forcibly sucked from the nozzles 15 for the respective color types of ink.

Figure 9:
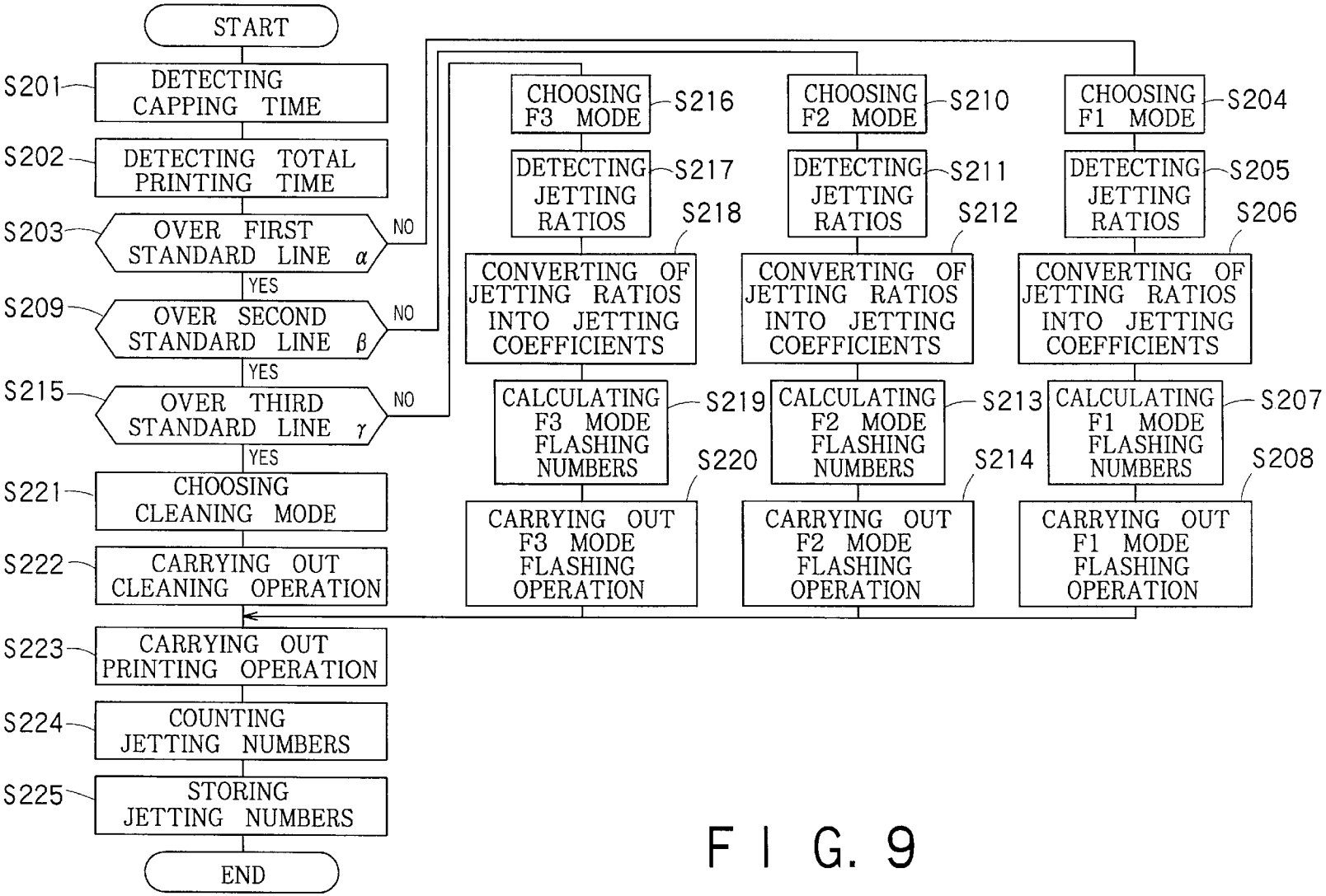
FIG. 9 is a flow chart showing an operation of the third embodiment of the ink-jet recording apparatus according to the invention.

If the flushing mode is chosen, the flushing controller 130 and the head driver 129 carry out the flushing operation (see FIG. 9).

The printing operation is carried out after the flushing operation or the cleaning operation (S111*c*). During the printing operation, the jetting number counting unit 136 counts respective numbers of times ink has been jetted from the nozzles 15 for the respective color types of ink (S112*c*). At the end of the printing operation, the storing part 139 temporarily stores the numbers of times (jetting numbers) counted by the jetting number counting unit 136 as jetting ratios, which mean the percentages of the numbers of times to the whole printing area of one recording paper (S113*c*). The jetting ratios are prepared in order to calculate the flushing numbers or the suction volumes for the flushing or cleaning operation at the starting of the next printing operation. Thus, the printing at the starting of the printing operation is effectively made stable by considering the jetting numbers for the flushing or cleaning operation.

In the above embodiment, when ink in the respective nozzles 15 have different viscosities, the ink can be jetted from the nozzles 15 the respective flushing number of times in the flushing operation, which number is based on the jetting number having a relation to the difference of the viscosity of the ink. In addition, the respective suction volumes of the ink can be sucked from the respective nozzles 15 in the cleaning operation, which volume is based on the jetting number having a relation to the difference in the viscosity of the ink. Therefore, there is no problem caused by the difference in the rates of increasing viscosity depending on the frequencies with which the nozzles are used, although the frequencies may be effected by the color types of the ink or the arranged positions of the nozzles 15. That is, the volume of the waste ink can be restrained even when there is a difference in the rates of increasing viscosity depending on the types of ink and so on. The flushing or cleaning operation can also make the printing operation stable. The efficient flushing or cleaning operation for the nozzles for the types of the ink respectively or for all the nozzles, can reduce the volume of the waste ink necessary to recover the ability of the nozzle to jet ink. That is, the volume of ink capable of being used for the printing operation can be increased, and the total volume of the waste ink can be reduced.

In the above example, the suction coefficients as well as the jetting coefficients are the same for all the color types of ink. However, the greater the rate of increasing viscosity the ink has, the larger the jetting coefficient or the suction volume may be set to. In the case, the greater the rate of increasing viscosity the ink in the nozzles has, the larger the flushing numbers or the suction volumes, for the nozzles may be set to. Then, the printing operation is made more stable, the flushing area may become larger, and the suction volume necessary to recover the ability of the nozzle to jet ink may be smaller.

A program for controlling the above element or elements in the computer system, and a storage unit storing the program and capable of being read by a computer, are also provided. The above element or elements may be controlled by the computer system by using a general program such as an OS, a program including a command or commands for controlling the general program, and a storage unit storing the program and capable of being read by a computer.

In addition, in the above example, the flushing conditions (flushing numbers) and the cleaning conditions (suction volumes) are different for the nozzles even for each color type of ink. However, the same flushing number and the same suction volume may be applied to all the nozzles belonging to the same ink connection for one type of ink. In the case, the flushing number or the suction volume is preferably the one calculated for the nozzle having the smallest jetting coefficient or the smallest suction coefficient. For example, in one ink-connection, if the smallest jetting coefficient of the nozzles is 3.0, a flushing number that is calculated with the jetting coefficient 3.0 might be applied to all the nozzles. Similarly, in one ink-connection, if the smallest suction coefficient of the nozzles is 4.0, a suction volume that is calculated with the suction coefficient 4.0 might be applied to all the nozzles. In the case, the head driver or the pump driver may be more controlled than the case of using the respective flushing numbers or the respective suction volumes for the respective nozzles.

As described above, according to the ink-jet recording head of the invention, when the ink has a relatively greater viscosity; a large volume of the ink can be jetted from the nozzle in the flushing operation to recover the ability of the nozzle to jet ink. Therefore, there is no problem caused by the difference in the rates of increasing viscosity depending on the types of ink and so on. On the other hand, when the ink has a relatively small viscosity, a relatively small volume of the ink can be jetted from the nozzle in the flushing operation to recover the ability of the nozzle to jet ink. Therefore, the volume of the wasted ink can be restrained even when there is a difference in the rates of increasing viscosity depending on the types of ink and so on. The flushing operation can also make the starting of the printing operation stable. In addition, the flushing operation can prevent an air bubble from being taken in the nozzle from which the ink having a relatively greater viscosity can be jetted.

In addition, the flushing area (which represents conditions capable of recovering the ability of nozzles to jet ink by only the flushing operation) becomes larger than the conventional one by introducing the efficient flushing operation for the nozzles for the respective types of the ink respectively. Therefore, the volume of the waste ink necessary to recover the ability of the nozzle to jet ink can be reduced, and the volume of ink capable of being used for the printing operation can be increased. The total volume of the waste ink can be also reduced.

If the flushing operation controller may control the number of times the ink (inkdrop) is jetted by the driver in order to control the volumes of the jetted ink in the flushing operation, the numbers of times may be predetermined for the respective types of the ink respectively. In the case, this flushing operation can be controlled very simply and easy.

In addition, the ink-jet recording apparatus may include a capping unit capable of sealing the nozzles of the recording head, and a capping time measuring unit for measuring a capping time for which the nozzles of the head are sealed by the capping unit. In the case, the setting unit may set up the volumes of ink which should be jetted from the nozzles in the flushing operation in such a manner that the volumes of ink are larger when the capping time is longer than a predetermined time. That is, the degrees (i.e., rate of increase) of the viscosity of the ink in the nozzles are determined by the capping time (in addition, of course, to the types of ink to be jetted). This flushing operation can be easily controlled to recover the ability of the nozzles to jet ink very efficiently. Similarly, the ink-jet recording apparatus may also include a capping unit capable of sealing the nozzles of the recording head, and a printing time measuring unit for measuring a printing time for which the nozzles of the head are away from the capping unit to carry out a printing operation until the nozzles are moved back to and sealed by the capping unit. In the case, the setting unit may set up the volumes of ink which should be jetted from the nozzles in the flushing operation in such a manner that the volumes of ink are larger when the printing time is longer than a predetermined time. That is, the degrees of the viscosity of the ink in the nozzles are judged by the printing time. This flushing operation can be easily controlled to recover the ability of the nozzles to jet ink very efficiently.

When the capping time or the printing time is compared with a plurality of predetermined times, the volumes of ink which should be jetted may be set stepwise to further reduce the wasted ink. The plurality of predetermined times may be different in the respective types of the ink.

The volumes of ink which should be jetted stepping up when the capping time is longer than a predetermined time may be larger for the nozzles jetting ink that has a greater rate of increasing viscosity. Similarly, the volumes of ink which should be jetted stepping up when the printing time is longer than a predetermined time may be larger for the nozzles jetting ink that has a greater rate of increasing viscosity. In these cases, the ability of the nozzles to jet ink can be recovered more surely by jetting the larger volumes of the ink when the ink has a greater viscosity because of the greater rate of increasing viscosity, the long capping time and/or the long printing time.

The ink-jet recording apparatus may include a jetting number counting unit for counting respective numbers of times the ink has been jetted from the nozzles belonging to the respective classes during a printing operation. In the case, the setting unit may set up the volumes of ink which should be jetted from the nozzles during the flushing operation according to the numbers of times counted by the jetting number counting unit.

In addition, when the ink has a relatively greater viscosity, a large volume of the ink may be jetted from the nozzle in the flushing operation to recover the ability of the nozzle to jet ink. Therefore, there may be no problem caused by the difference in the rates of increasing viscosity depending on the frequencies with which the nozzles are used. On the other hand, when the ink has a relatively small viscosity, a small volume of the ink may be jetted from the nozzle in the flushing operation to recover the ability of the nozzle to jet ink. Therefore, the volume of the wasted ink may be restrained even when there is any difference in the rates of increasing viscosity depending on the frequencies with which the nozzles are used. This flushing operation may also make the printing operation stable. In addition, this flushing operation may prevent an air bubble from being formed in the nozzle from which the ink having a relatively greater viscosity can be jetted.

As described above, the setting unit may have a coefficient determining part for determining multiplying coefficients according to the numbers of times counted by the jetting number counting unit, a provisional volume storage unit for storing a predetermined and provisional volume of ink for the flushing operation, and a calculating body for calculating the volumes of ink which should be jetted from the nozzles by multiplying the multiplying coefficients and the provisional volume of ink together. In the case, the appropriate conditions for the flushing operation may be easily obtained. The flushing operation may be easily controlled, too.

As described above, the ink-jet recording apparatus may include a storage unit capable of storing data whether the power supply is given or not. The storage unit may store the jetting numbers (jetting ratios) counted by the jetting number counting unit at the end of the printing operation. At the next starting of the printing operation, the setting unit can set up the volumes of ink which should be jetted from the nozzles during the flushing operation according to the numbers of times stored by the storage unit. In the case, the numbers of times the ink has been jetted in the previous printing operation can be taken in consideration for the flushing operation at the starting of the following printing operation. This flushing operation can recover the ability of the nozzles to jet ink very efficiently to make the starting of the printing operation stable.

The flushing conditions may be determined based on the jetting numbers counted from the latest flushing or cleaning time to the current time. In the case, the ability of the nozzles to jet ink may be recovered, and the throughput may be raised.

As described above, the ink-jet recording apparatus may also include the capping unit capable of sealing the nozzles of the recording head, the capping time measuring unit for measuring the capping time for which the nozzles of the head are sealed by the capping unit, and the printing time measuring unit for measuring the printing time form when the nozzles of the head are moved away from the capping unit to carry out a printing operation until the nozzles are moved back to and sealed by the capping unit, as well as the jetting number counting unit. In this case, the setting unit may set up the volumes of ink which should be jetted from the nozzles in the flushing operation in such a manner that the volumes of ink are larger when either the capping time or the printing time is longer. That is, the degrees (i.e., rate of increase) of the viscosity of the ink in the nozzles are judged by (calculated based on) the capping time and/or the printing time, because the longer the capping time or the printing time is, the more the viscosity of the ink increases and the worse the ability of the nozzle to jet ink deteriorates. The setting unit may also set up the volumes of ink which should be jetted from the nozzles in the flushing operation according to the number of times the ink has been jetted. This flushing operation may recover the ability of the nozzles to jet ink very efficiently. The flushing area may be enlarged, too.

In the case, the volumes of ink which should be jetted in the flushing operation may be larger for the nozzles jetting ink that has a greater rate of increasing viscosity. This flushing operation may recover the ability of the nozzles to jet ink very efficiently according to both the rate of increasing viscosity of the ink and the number of times the ink has been jetted. The flushing area may be enlarged, too.

In addition, when the ink has a relatively greater viscosity, a large volume of the ink can be sucked from the nozzle in the cleaning operation to recover the ability of the nozzle to jet ink. Therefore, there is no problem caused by the difference in the rates of increasing viscosity depending on the frequencies with which the nozzles are used. This cleaning operation can achieve less wasted ink to make the printing operation stable.

What is claimed is:

1. An inkjet recording apparatus comprising:

a recording head having a plurality of nozzles, said plurality of nozzles comprising a first class of nozzles and a second class of nozzles;

a driver for jetting ink from said nozzles so as to perform a flushing operation;

a capping unit for sealing said nozzles;

a capping time measuring device for measuring a capping time during which said nozzles are sealed by said capping unit;

a setting unit for determining a volume of ink to be jetted from said nozzles during the flushing operation, wherein said setting unit determines a volume of ink to be jetted from said first class of nozzles based on an actual rate of increasing viscosity of the ink to be jetted from said first class of nozzles, said setting unit being adapted to calculate the actual rate of increasing viscosity of the ink to be jetted from said first class of nozzles based on a type of the ink to be jetted from said first class of nozzles and on the capping time measured by said capping time measuring device, and wherein said setting unit determines a volume of ink to be jetted from said second class of nozzles based on an actual rate of increasing viscosity of the ink to be jetted from said second class of nozzles, said setting unit being adapted to calculate the actual rate of increasing viscosity of the ink to be jetted from said second class of nozzles based on a type of the ink to be jetted from said second class of nozzles and on the capping time measured by said capping time measuring device; and a flushing operation controller for controlling said driver during the flushing operation such that a volume of ink actually jetted from said first class of nozzles and said second class of nozzles will be coincident with the volumes of ink separately determined by said setting unit to be jetted from said first class of nozzles and said second class of nozzles, respectively.

2. The apparatus of claim 1, wherein said first class of nozzles includes a plurality of nozzles and said second class of nozzles includes a plurality of nozzles, and wherein said recording head is adapted to accommodate ink to be jetted having a rate of increasing viscosity.

3. The apparatus of claim 1, wherein said first class of nozzles includes only a single nozzle and said second class of nozzles includes only a single nozzle.

4. The apparatus of claim 1, wherein said setting unit is adapted to determine a volume of ink to be jetted from said nozzles during the flushing operation such that a volume of ink to be jetted from a respective one of said first class of nozzles and said second class of nozzles is large when the ink to be jetted from said respective one of said first class of nozzles and said second class of nozzles has a large rate of increasing viscosity, and such that a volume of ink to be jetted from a respective one of said first class of nozzles and said second class of nozzles is small when the ink to be jetted from said respective one of said first class of nozzles and said second class of nozzles has a small rate of increasing viscosity.

5. The apparatus of claim 1, wherein said setting unit is adapted to determine a volume of ink to be jetted from said nozzles during the flushing operation such that a volume of ink to be jetted will be larger as the capping time becomes larger.

6. The apparatus of claim 1, further comprising a printing time measuring unit for measuring a printing time during which said nozzles are not sealed by said capping unit so as at perform a printing operation;

wherein said setting unit is adapted to calculate the actual rate of increasing viscosity of the ink to be jetted from said first class of nozzles further based on the printing time measured by said printing time measuring unit, and wherein said setting unit is adapted to calculate the actual rate of increasing viscosity of the ink to be jetted from said second class of nozzles further based on the printing time measured by said printing time measuring unit.

7. The apparatus of claim 6, wherein said setting unit is adapted to determine a volume of ink to be jetted from said nozzles during the flushing operation such that a volume of ink to be jetted will be larger as the printing time becomes larger.

8. The apparatus of claim 1, wherein said setting unit and said flushing operation controller comprise a controlling unit for controlling said recording head, said driver, and said capping unit.

9. The apparatus of claim 8, further comprising:

a storage unit adapted to be read by a computer, said storage unit storing a program for operating said controlling unit.

10. The apparatus of claim 9, wherein said program comprises a first program, said storage unit storing a second program to be executed by the computer, said first program including a command to run said second program for operating said controlling unit.

11. An ink-jet recording apparatus comprising:

a recording head having a plurality of nozzles, said plurality of nozzles comprising a first class of nozzles and a second class of nozzles;

a driver for jetting ink from said nozzles so as to perform a flushing operation;

a jetting number counting unit for counting a number of inkdrops jetted from said first class of nozzles and from said second class of nozzles, respectively, during a printing operation;

a setting unit for determining a volume of ink to be jetted from said nozzles during the flushing operation, wherein said setting unit separately determines a volume of ink to be jetted from said first class of nozzles and from said second class of nozzles, respectively, said setting unit including:

a coefficient determining portion for determining a first class coefficient and a second class coefficient based on the number of inkdrops jetted from said first class of nozzles and from said second class of nozzles, respectively, counted by said jetting number counting unit;

a provisional volume storage unit for storing a first class provisional number corresponding to a provisional volume of ink to be jetted from said first class of nozzles, and for storing a second class provisional number corresponding to a provisional volume of ink to be jetted from said second class of nozzles;

a provisional volume determining unit for calculating an actual rate of increasing viscosity of the ink to be jetted from said first class of nozzles based on a type of the ink to be jetted from said first class of nozzles and on at least one measured parameter of an operation of the ink-jet recording apparatus, and for determining the first class provisional number based on the actual rate of increasing viscosity of the ink to be jetted from said first class of nozzles, and for calculating an actual rate of increasing viscosity of the ink to be jetted from said second class of nozzles based on a type of the ink to be jetted from said second class of nozzles and on at least one measured parameter of an operation of the ink-jet recording apparatus, and for determining the second class provisional number based on the actual rate of increasing viscosity of the ink to be jetted from said second class of nozzles, and for causing said provisional volume storage unit to store the provisional numbers; and a calculating body for calculating a volume of ink to be jetted from said first class of nozzles and from said second class of nozzles by multiplying the first class coefficient and the second class coefficient by the first class provisional number and the second class provisional number, respectively; and a flushing operation controller for controlling said driver during the flushing operation such that a volume of ink actually jetted from said first class of nozzles and from said second class of nozzles will be coincident with the respective volumes of ink separately calculated by said calculating body of said setting unit.

12. The apparatus of claim 11, wherein said jetting number counting unit is adapted to count a number of inkdrops jetted from said first class of nozzles and from said second class of nozzles, respectively, between a latest starting time of the printing operation until a present time.

13. The apparatus of claim 12, further comprising:

a storage unit adapted to store data regardless of whether a power supply is connected thereto, said storage unit being connected to said jetting number counting unit so as to store the number of inkdrops jetted from said first class of nozzles and from said second class of nozzles, respectively.

14. The apparatus of claim 11, wherein said jetting number counting unit is adapted to count a number of inkdrops jetted from said first class of nozzles and from said second class of nozzles, respectively, between a latest starting time of one of the flushing operation and a cleaning operation until a present time.

15. The apparatus of claim 11, further comprising:

a capping unit for sealing said nozzles of said recording head;

a printing time measuring unit for measuring a printing time during which said nozzles are not sealed by said capping unit so as at perform a printing operation, wherein said provisional volume determining unit is adapted to determine the first class provisional number and the second class provisional number further based on the printing time measured by said printing time measuring unit.

16. The apparatus of claim 11, further comprising:

a capping unit for sealing said nozzles of said recording head;

a capping time measuring unit for measuring a capping time during which said nozzles are sealed, wherein said provisional volume determining unit is adapted to determine the first class provisional number and the second class provisional number further based on the capping time measured by said capping time measuring unit.

17. The apparatus of claim 11, wherein said setting unit is adapted to determine a volume of ink to be jetted from said nozzles based on a smaller of the number of inkdrops jetted from said first class of nozzles and the number of inkdrops jetted from said second class of nozzles.

18. The apparatus of claim 11, wherein said first class of nozzles includes a plurality of nozzles and said second class of nozzles includes a plurality of nozzles, and wherein said recording head is adapted to accommodate ink to be jetted having a rate of increasing viscosity.

19. The apparatus of claim 11, wherein said first class of nozzles includes only a single nozzle and said second class of nozzles includes only a single nozzle.

20. The apparatus of claim 11, wherein said setting unit and said flushing operation controller comprise a controlling unit for controlling said recording head and said driver.

21. The apparatus of claim 20, further comprising:

a storage unit adapted to be read by a computer, said storage unit storing a program for operating said controlling unit.

22. The apparatus of claim 21, wherein said program comprises a first program, said storage unit storing a second program to be executed by the computer, said first program including a command to run said second program for operating said controlling unit.

23. The apparatus of claim 11, further comprising a capping time measuring unit for measuring a capping time during which said nozzles are sealed by a capping unit;

wherein the at least one measured parameter of the operation of the ink-jet recording apparatus used by said provisional volume determining unit to calculate the actual rate of increasing viscosity of the ink to be jetted from said first class of nozzles and said second class of nozzles comprises the capping time measured by said capping time measuring unit.

24. The apparatus of claim 23, further comprising a printing time measuring unit for measuring a printing time during which said nozzles are not sealed by the capping unit so as at perform a printing operation;

wherein the at least one measured parameter of the operation of the ink-jet recording apparatus used by said provisional volume determining unit to calculate the actual rate of increasing viscosity of the ink to be jetted from said first class of nozzles and said second class of nozzles further comprises the printing time measured by said printing time measuring unit.

25. The apparatus of claim 11, further comprising a printing time measuring unit for measuring a printing time during which said nozzles are not sealed by said capping unit so as at perform a printing operation;

wherein the at least one measured parameter of the operation of the ink-jet recording apparatus used by said provisional volume determining unit to calculate the actual rate of increasing viscosity of the ink to be jetted from said first class of nozzles and said second class of nozzles comprises the printing time measured by said printing time measuring unit.

26. A controlling unit for controlling an ink-jet recording apparatus having a recording head having a plurality of nozzles, said plurality of nozzles comprising a first class of nozzles and a second class of nozzles; a driver for jetting ink from said nozzles so as to perform a flushing operation; a capping unit for sealing said nozzles; and a capping time measuring device for measuring a capping time during which said nozzles are sealed by said capping unit; comprising:

a setting unit for determining a volume of ink to be jetted from said nozzles during the flushing operation, wherein said setting unit determines a volume of ink to be jetted from said first class of nozzles based on an actual rate of increasing viscosity of the ink to be jetted from said first class of nozzles, said setting unit being adapted to calculate the actual rate of increasing viscosity of the ink to be jetted from said first class of nozzles based on a type of the ink to be jetted from said first class of nozzles and on the capping time measured by said capping time measuring device, and wherein said setting unit determines a volume of ink to be jetted from said second class of nozzles based on an actual rate of increasing viscosity of the ink to be jetted from said second class of nozzles, said setting unit being adapted to calculate the actual rate of increasing viscosity of the ink to be jetted from said second class of nozzles based on a type of the ink to be jetted from said second class of nozzles and on the capping time measured by said capping time measuring device; and a flushing operation controller for controlling said driver during the flushing operation such that a volume of ink actually jetted from said first class of nozzles and said second class of nozzles will be coincident with the volumes of ink separately determined by said setting unit to be jetted from said first class of nozzles and said second class of nozzles, respectively.

27. A storage unit capable of being read by a computer, storing a program for materializing a controlling unit for controlling an ink-jet recording apparatus having a recording head having a plurality of nozzles, said plurality of nozzles comprising a first class of nozzles and a second class of nozzles; a driver for jetting ink from said nozzles so as to perform a flushing operation; a capping unit for sealing said nozzles; and a capping time measuring device for measuring a capping time during which said nozzles are sealed by said capping unit;

said controlling unit comprising:

a setting unit for determining a volume of ink to be jetted from said nozzles during the flushing operation, wherein said setting unit determines a volume of ink to be jetted from said first class of nozzles based on an actual rate of increasing viscosity of the ink to be jetted from said first class of nozzles, said setting unit being adapted to calculate the actual rate of increasing viscosity of the ink to be jetted from said first class of nozzles based on a type of the ink to be jetted from said first class of nozzles and on the capping time measured by said capping time measuring device, and wherein said setting unit determines a volume of ink to be jetted from said second class of nozzles based on an actual rate of increasing viscosity of the ink to be jetted from said second class of nozzles, said setting unit being adapted to calculate the actual rate of increasing viscosity of the ink to be jetted from said second class of nozzles based on a type of the ink to be jetted from said second class of nozzles and on the capping time measured by said capping time measuring device; and a flushing operation controller for controlling said driver during the flushing operation such that a volume of ink actually jetted from said first class of nozzles and said second class of nozzles will be coincident with the volumes of ink separately determined by said setting unit to be jetted from said first class of nozzles and said second class of nozzles, respectively.

28. A storage unit capable of being read by a computer, storing a program including a command for controlling a second program executed by a computer system including a computer, said program being executed by the computer system to control the second program to materialize a controlling unit for controlling an ink-jet recording apparatus having a recording head having a plurality of nozzles, said plurality of nozzles comprising a first class of nozzles and a second class of nozzles; a driver for jetting ink from said nozzles so as to perform a flushing operation; a capping unit for sealing said nozzles; and a capping time measuring device for measuring a capping time during which said nozzles are sealed by said capping unit;

said controlling unit comprising:

a setting unit for determining a volume of ink to be jetted from said nozzles during the flushing operation, wherein said setting unit determines a volume of ink to be jetted from said first class of nozzles based on an actual rate of increasing viscosity of the ink to be jetted from said first class of nozzles, said setting unit being adapted to calculate the actual rate of increasing viscosity of the ink to be jetted from said first class of nozzles based on a type of the ink to be jetted from said first class of nozzles and on the capping time measured by said capping time measuring device, and wherein said setting unit determines a volume of ink to be jetted from said second class of nozzles based on an actual rate of increasing viscosity of the ink to be jetted from said second class of nozzles, said setting unit being adapted to calculate the actual rate of increasing viscosity of the ink to be jetted from said second class of nozzles based on a type of the ink to be jetted from said second class of nozzles and on the capping time measured by said capping time measuring device; and a flushing operation controller for controlling said driver during the flushing operation such that a volume of ink actually jetted from said first class of nozzles and said second class of nozzles will be coincident with the volumes of ink separately determined by said setting unit to be jetted from said first class of nozzles and said second class of nozzles, respectively.

29. A controlling unit for controlling an inkjet recording apparatus having a recording head having a plurality of nozzles, said plurality of nozzles comprising a first class of nozzles and a second class of nozzles; a driver for jetting ink from said nozzles so as to perform a flushing operation; and a jetting number counting unit for counting a number of inkdrops jetted from said first class of nozzles and from said second class of nozzles, respectively, during a printing operation; comprising:

a setting unit for determining a volume of ink to be jetted from said nozzles during the flushing operation, wherein said setting unit separately determines a volume of ink to be jetted from said first class of nozzles and from said second class of nozzles, respectively, said setting unit including:

a coefficient determining portion for determining a first class coefficient and a second class coefficient based on the number of inkdrops jetted from said first class of nozzles and from said second class of nozzles, respectively, counted by said jetting number counting unit;

a provisional volume storage unit for storing a first class provisional number corresponding to a provisional volume of ink to be jetted from said first class of nozzles, and for storing a second class provisional number corresponding to a provisional volume of ink to be jetted from said second class of nozzles;

a provisional volume determining unit for calculating an actual rate of increasing viscosity of the ink to be jetted from said first class of nozzles based on a type of the ink to be jetted from said first class of nozzles and on at least one measured parameter of an operation of the ink-jet recording apparatus, and for determining the first class provisional number based on the actual rate of increasing viscosity of the ink to be jetted from said first class of nozzles, and for calculating an actual rate of increasing viscosity of the ink to be jetted from said second class of nozzles based on a type of the ink to be jetted from said second class of nozzles and on at least one measured parameter of an operation of the ink-jet recording apparatus, and for determining the second class provisional number based on the actual rate of increasing viscosity of the ink to be jetted from said second class of nozzles, and for causing said provisional volume storage unit to store the provisional numbers; and a calculating body for calculating a volume of ink to be jetted from said first class of nozzles and from said second class of nozzles by multiplying the first class coefficient and the second class coefficient by the first class provisional number and the second class provisional number, respectively; and a flushing operation controller for controlling said driver during the flushing operation such that a volume of ink actually jetted from said first class of nozzles and from said second class of nozzles will be coincident with the respective volumes of ink separately calculated by said calculating body of said setting unit.

30. A storage unit capable of being read by a computer, storing a program for materializing a controlling unit for controlling an ink-jet recording apparatus having a recording head having a plurality of nozzles, said plurality of nozzles comprising a first class of nozzles and a second class of nozzles; a driver for jetting ink from said nozzles so as to perform a flushing operation; and a jetting number counting unit for counting a number of inkdrops jetted from said first class of nozzles and from said second class of nozzles, respectively, during a printing operation;

said controlling unit comprising:

a setting unit for determining a volume of ink to be jetted from said nozzles during the flushing operation, wherein said setting unit separately determines a volume of ink to be jetted from said first class of nozzles and from said second class of nozzles, respectively, said setting unit including:

a coefficient determining portion for determining a first class coefficient and a second class coefficient based on the number of inkdrops jetted from said first class of nozzles and from said second class of nozzles, respectively, counted by said jetting number counting unit;

a provisional volume storage unit for storing a first class provisional number corresponding to a provisional volume of ink to be jetted from said first class of nozzles, and for storing a second class provisional number corresponding to a provisional volume of ink to be jetted from said second class of nozzles;

a provisional volume determining unit for calculating an actual rate of increasing viscosity of the ink to be jetted from said first class of nozzles based on a type of the ink to be jetted from said first class of nozzles and on at least one measured parameter of an operation of the ink-jet recording apparatus, and for determining the first class provisional number based on the actual rate of increasing viscosity of the ink to be jetted from said first class of nozzles, and for calculating an actual rate of increasing viscosity of the ink to be jetted from said second class of nozzles based on a type of the ink to be jetted from said second class of nozzles and on at least one measured parameter of an operation of the ink-jet recording apparatus, and for determining the second class provisional number based on the actual rate of increasing viscosity of the ink to be jetted from said second class of nozzles, and for causing said provisional volume storage unit to store the provisional numbers; and a calculating body for calculating a volume of ink to be jetted from said first class of nozzles and from said second class of nozzles by multiplying the first class coefficient and the second class coefficient by the first class provisional number and the second class provisional number, respectively; and a flushing operation controller for controlling said driver during the flushing operation such that a volume of ink actually jetted from said first class of nozzles and from said second class of nozzles will be coincident with the respective volumes of ink separately calculated by said calculating body of said setting unit.

31. A storage unit capable of being read by a computer, storing a program including a command for controlling a second program executed by a computer system including a computer, said program being executed by the computer system to control the second program to materialize a controlling unit for controlling an ink-jet recording apparatus having a recording head having a plurality of nozzles, said plurality of nozzles comprising a first class of nozzles and a second class of nozzles; a driver for jetting ink from said nozzles so as to perform a flushing operation; and a jetting number counting unit for counting a number of inkdrops jetted from said first class of nozzles and from said second class of nozzles, respectively, during a printing operation;

said controlling unit comprising:

a setting unit for determining a volume of ink to be jetted from said nozzles during the flushing operation, wherein said setting unit separately determines a volume of ink to be jetted from said first class of nozzles and from said second class of nozzles, respectively, said setting unit including:

a coefficient determining portion for determining a first class coefficient and a second class coefficient based on the number of inkdrops jetted from said first class of nozzles and from said second class of nozzles, respectively, counted by said jetting number counting unit;

a provisional volume storage unit for storing a first class provisional number corresponding to a provisional volume of ink to be jetted from said first class of nozzles, and for storing a second class provisional number corresponding to a provisional volume of ink to be jetted from said second class of nozzles;

a provisional volume determining unit for calculating an actual rate of increasing viscosity of the ink to be jetted from said first class of nozzles based on a type of the ink to be jetted from said first class of nozzles and on at least one measured parameter of an operation of the ink-jet recording apparatus, and for determining the first class provisional number based on the actual rate of increasing viscosity of the ink to be jetted from said first class of nozzles, and for calculating an actual rate of increasing viscosity of the ink to be jetted from said second class of nozzles based on a type of the ink to be jetted from said second class of nozzles and on at least one measured parameter of an operation of the ink-jet recording apparatus, and for determining the second class provisional number based on the actual rate of increasing viscosity of the ink to be jetted from said second class of nozzles, and for causing said provisional volume storage unit to store the provisional numbers; and a calculating body for calculating a volume of ink to be jetted from said first class of nozzles and from said second class of nozzles by multiplying the first class coefficient and the second class coefficient by the first class provisional number and the second class provisional number, respectively; and a flushing operation controller for controlling said driver during the flushing operation such that a volume of ink actually jetted from said first class of nozzles and from said second class of nozzles will be coincident with the respective volumes of ink separately calculated by said calculating body of said setting unit.

32. An ink-jet recording apparatus comprising:

a recording head having a plurality of nozzles, said plurality of nozzles comprising a first class of nozzles and a second class of nozzles;

a driver for jetting ink from said nozzles so as to perform a flushing operation;

a setting unit for determining a volume of ink to be jetted from said nozzles during the flushing operation, wherein said setting unit determines a volume of ink to be jetted from said first class of nozzles based on an actual rate of increasing viscosity of the ink to be jetted from said first class of nozzles, said setting unit being adapted to calculate the actual rate of increasing viscosity of the ink to be jetted from said first class of nozzles based on a type of the ink to be jetted from said first class of nozzles and on at least one measured parameter of an operation of the ink-jet recording apparatus, and wherein said setting unit determines a volume of ink to be jetted from said second class of nozzles based on an actual rate of increasing viscosity of the ink to be jetted from said second class of nozzles, said setting unit being adapted to calculate the actual rate of increasing viscosity of the ink to be jetted from said second class of nozzles based on a type of the ink to be jetted from said second class of nozzles and on at least one measured parameter of the operation of the ink-jet recording apparatus; and a flushing operation controller for controlling said driver during the flushing operation such that a volume of ink actually jetted from said first class of nozzles and said second class of nozzles will be coincident with the volumes of ink separately determined by said setting unit to be jetted from said first class of nozzles and said second class of nozzles, respectively.

33. The apparatus of claim 32, further comprising a capping time measuring device for measuring a capping time during which said nozzles are sealed by a capping unit;

wherein the at least one measured parameter of the operation of the ink-jet recording apparatus used by said setting unit to calculate the actual rate of increasing viscosity of the ink to be jetted from said first class of nozzles and said second class of nozzles comprises the capping time measured by said capping time measuring unit.

34. The apparatus of claim 33, further comprising a printing time measuring unit for measuring a printing time during which said nozzles are not sealed by the capping unit so as at perform a printing operation;

wherein the at least one measured parameter of the operation of the ink-jet recording apparatus used by said setting unit to calculate the actual rate of increasing viscosity of the ink to be jetted from said first class of nozzles and said second class of nozzles further comprises the printing time measured by said printing time measuring unit.

35. The apparatus of claim 32, further comprising a printing time measuring unit for measuring a printing time during which said nozzles are not sealed by said capping unit so as at perform a printing operation;

wherein the at least one measured parameter of the operation of the ink-jet recording apparatus used by said setting unit to calculate the actual rate of increasing viscosity of the ink to be jetted from said first class of nozzles and said second class of nozzles comprises the printing time measured by said printing time measuring unit.

* * * * *